US007938708B2

(12) United States Patent
Willet et al.

(10) Patent No.: US 7,938,708 B2
(45) Date of Patent: May 10, 2011

(54) ARTICULATED WALKING TOY DEVICE

(75) Inventors: William Willet, Irvine, CA (US); Vladimir Leonov, Mesa, AZ (US)

(73) Assignee: Mattel, Inc., El Segundo, CA (US)

( * ) Notice: Subject to any disclaimer, the term of this patent is extended or adjusted under 35 U.S.C. 154(b) by 591 days.

(21) Appl. No.: 11/556,281

(22) Filed: Nov. 3, 2006

(65) Prior Publication Data

US 2008/0108276 A1 May 8, 2008

Related U.S. Application Data

(60) Provisional application No. 60/732,966, filed on Nov. 3, 2005.

(51) Int. Cl.
*A63H 3/00* (2006.01)

(52) U.S. Cl. ..... 446/330; 446/356; 446/355

(58) Field of Classification Search ..... 446/356, 446/330, 355

See application file for complete search history.

(56) References Cited

U.S. PATENT DOCUMENTS

| | | | |
|---|---|---|---|
| 188,841 | A | 3/1877 | Baxter, Jr. |
| 538,007 | A | 4/1895 | Adam |
| 1,196,548 | A | 8/1916 | Keffer |
| 1,511,928 | A | 10/1924 | Zboril |
| 1,576,956 | A | 3/1926 | Dunshee |
| 1,770,248 | A | 7/1930 | Vilet |
| 2,051,221 | A | 8/1936 | Nodding |
| 2,667,719 | A | 2/1954 | Edwardson |
| 2,827,735 | A | 3/1958 | Grimm, Jr. |
| 2,918,738 | A | 12/1959 | Barr |
| 3,002,578 | A | 10/1961 | Kraus |
| 3,103,762 | A | 9/1963 | Glass et al. |
| 3,226,878 | A | 1/1966 | Glass et al. |
| 3,331,463 | A | 7/1967 | Kramer |
| 3,579,900 | A | 5/1971 | Brown |
| 3,603,029 | A | 9/1971 | Nutting |
| 3,678,617 | A | 7/1972 | Nomura |
| 4,182,076 | A | 1/1980 | Gay et al. |
| 4,216,612 | A | 8/1980 | Erickson et al. |

(Continued)

FOREIGN PATENT DOCUMENTS

| | | |
|---|---|---|
| CN | 2690007 | 4/2005 |

(Continued)

OTHER PUBLICATIONS

Small World Toys 1995 Catalog; rec'd Feb. 1995; p. 36; Creepy Crawler Beetle.

(Continued)

*Primary Examiner* — Alvin A Hunter
*Assistant Examiner* — Urszula M Cegielnik
(74) *Attorney, Agent, or Firm* — Panitch Schwarze Belisario & Nadel LLP

(57) ABSTRACT

An articulated walking device, configured for movement across a surface, includes a frame and a plurality of leg assemblies movably engaged with the frame. Each leg assembly includes a leg member configured to rotate with respect to the frame about first and second axes at least generally transverse to one another. A drive mechanism operatively engaged with the plurality of leg assemblies actuates each of the leg members in like, predetermined, repeatable cycles of movement. The leg members are out of phase with one another, such that sufficient leg members are always supporting the toy device in an upright manner and immediately adjoining leg members do not move together in parallel.

27 Claims, 19 Drawing Sheets

U.S. PATENT DOCUMENTS 4,224,759 A 9/1980 Saint-Pierre et al.
4,302,903 A 12/1981 Pun
4,333,259 A 6/1982 Pin-Huang
D266,777 S 11/1982 Lucas, Jr. et al.
4,365,437 A 12/1982 Bartholet
4,527,650 A 7/1985 Bartholet
4,530,672 A 7/1985 Yoneda
4,579,013 A 4/1986 Van Essen
4,614,504 A 9/1986 Yamasaki
4,629,440 A 12/1986 McKittrick, Jr. et al.
D289,070 S 3/1987 Forbes et al.
4,666,419 A 5/1987 Droller et al.
4,680,022 A 7/1987 Hoshino
D291,711 S 9/1987 Dixon
4,708,685 A 11/1987 Udagawa
4,762,513 A 8/1988 Choy et al.
4,852,288 A 8/1989 Payne et al.
4,862,980 A 9/1989 Shkolnik
4,925,427 A 5/1990 Wu
5,005,658 A 4/1991 Bares et al.
5,040,626 A 8/1991 Paynter
5,112,265 A 5/1992 Naum
5,125,668 A 6/1992 Welte
5,158,493 A 10/1992 Morgrey
5,219,410 A 6/1993 Garrec
5,224,390 A 7/1993 Tysver
5,310,378 A 5/1994 Shannon
5,423,708 A 6/1995 Allen
D374,694 S 10/1996 Arai
5,613,317 A 3/1997 Ninegar
5,685,383 A 11/1997 Ferrante
5,701,878 A 12/1997 Moore et al.
5,724,954 A 3/1998 Smith
5,762,153 A 6/1998 Zamagni
5,842,533 A 12/1998 Takeuchi
5,857,533 A 1/1999 Clewett
D405,780 S 2/1999 Smith
D408,394 S 4/1999 Chin et al.
5,941,755 A 8/1999 Danielian
5,993,286 A 11/1999 Tacquard et al.
D418,551 S 1/2000 Kageyama et al.
6,012,962 A 1/2000 Arriola
6,036,572 A 3/2000 Sze
6,092,322 A 7/2000 Samaras
6,095,887 A 8/2000 Llorens
6,109,378 A 8/2000 Paakkunainen
6,123,600 A 9/2000 Yuen
6,165,043 A 12/2000 Terzian et al.
6,210,249 B1 4/2001 Stadlbauer
6,238,264 B1 5/2001 Kazami et al.
6,273,782 B1 8/2001 Chan et al.
6,290,567 B1 9/2001 Chiu
D461,855 S 8/2002 Ewert
D464,093 S 10/2002 Weiser et al.
6,478,314 B1 11/2002 Klann
6,481,512 B1 11/2002 Nagatsuka
6,481,513 B2 11/2002 Buehler
6,488,560 B2 12/2002 Nishikawa
6,527,619 B1 3/2003 Agostini et al.
6,588,701 B2 7/2003 Yavnai
D478,589 S 8/2003 Hussaini et al.
D478,590 S 8/2003 Hussaini et al.
6,620,021 B2 9/2003 Liu
6,648,720 B1 * 11/2003 Domingues ..... 446/356
6,652,352 B1 11/2003 MacArthur et al.
6,681,150 B1 1/2004 Haga et al.
6,695,673 B1 2/2004 Stadbauer
6,699,098 B1 3/2004 Kau
6,705,917 B2 3/2004 Filo
6,722,939 B2 4/2004 An
6,736,694 B2 5/2004 Hornsby et al.
6,752,683 B1 6/2004 Godfrey
6,866,557 B2 3/2005 Randall
D517,131 S 3/2006 Carruth
7,115,014 B2 10/2006 McGrath et al.
D576,217 S 9/2008 Pasko
2001/0029147 A1 10/2001 Hornsby et al.
2001/0054518 A1 12/2001 Buehler et al.
2002/0025756 A1 2/2002 Nishikawa
2002/0111113 A1 8/2002 Filo
2002/0193045 A1 12/2002 Lee et al.
2003/0017779 A1 1/2003 Sakai
2003/0092353 A1 5/2003 Liu
2003/0232570 A1 12/2003 An
2004/0038619 A1 2/2004 Kau
2004/0063382 A1 * 4/2004 Randall ..... 446/377
2006/0014470 A1 1/2006 Takahashi et al.

FOREIGN PATENT DOCUMENTS

EP 389 243 A2 9/1990
EP 399 720 A1 11/1990
GB 2 244 935 A 12/1991
JP 59 57074 A 4/1984
JP 61139567 A 6/1986
JP 2001071284 A 3/2001
JP 2001224866 A 8/2001
JP 2005193329 A 7/2005

OTHER PUBLICATIONS

CN200780016217.X office action issued Mar. 19, 2010.
Playthings® catalog, 2006. p. 32, Creepy Crawlers.
EP Supplemental Search Report issued on Nov. 4, 2010 in EP Application No. 06836949.5.

* cited by examiner

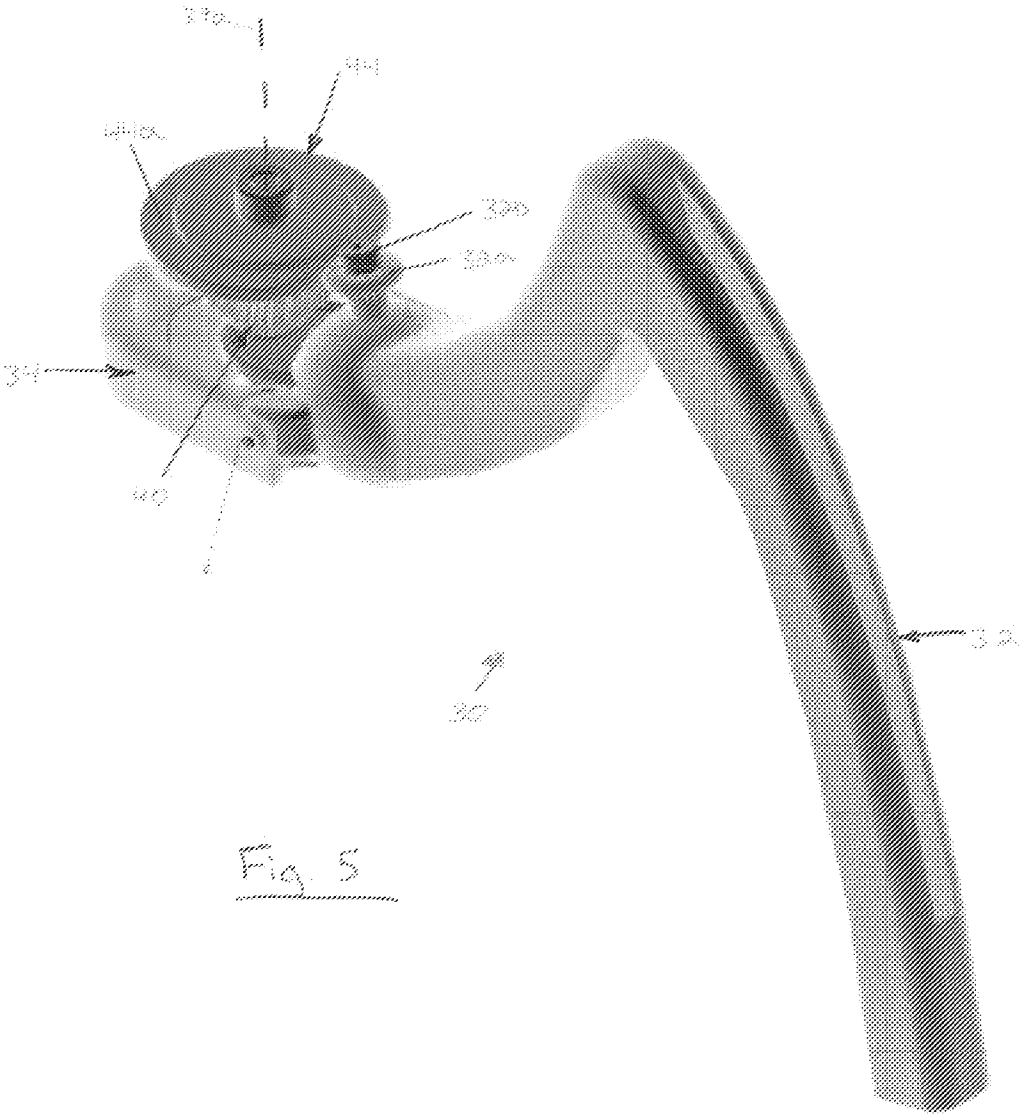
34
34a
34b
50
52
54
56
58
60
62
64
66
68
70
72
74
76
78
80
82
84
86
88
90
92
94
96
98
100
102
104
106
108
110
112
114
116
118
120
122
124
126
128

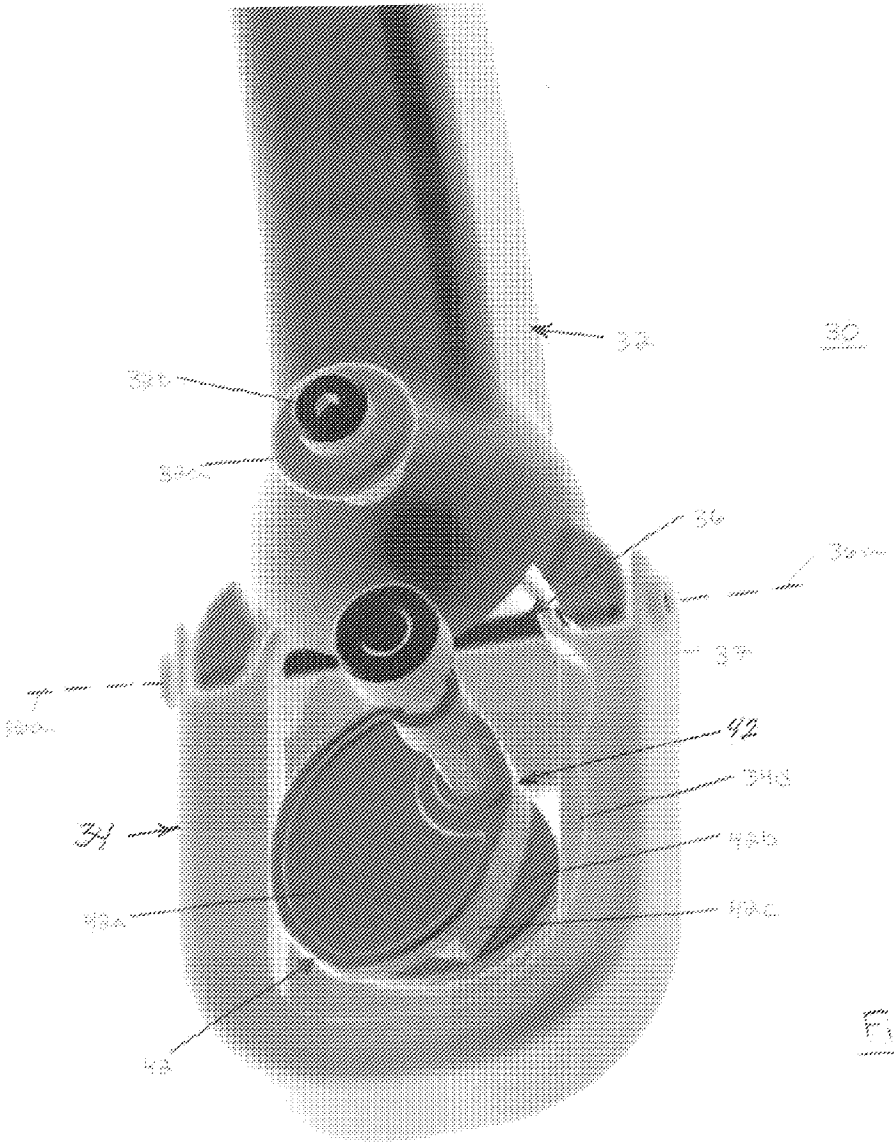
30
34
34a
34b
34c
34d
34e
34f
34g
34h
34i
34j
34k
34l
34m
34n
34o
34p
34q
34r
34s
34t
34u
34v
34w
34x
34y
34z
34aa
34ab
34ac
34ad
34ae
34af
34ag
34ah
34ai
34aj
34ak
34al
34am
34an
34ao
34ap
34aq
34ar
34as
34at
34au
34av
34aw
34ax
34ay
34az
34ba
34bb
34bc
34bd
34be
34bf
34bg
34bh
34bi
34bj
34bk
34bl
34bm
34bn
34bo
34bp
34bq
34br
34bs
34bt
34bu
34bv
34bw
34bx
34by
34bz
34ca
34cb
34cc
34cd
34ce
34cf
34cg
34ch
34ci
34cj
34ck
34cl
34cm
34cn
34co
34cp
34cq
34cr
34cs
34ct
34cu
34cv
34cw
34cx
34cy
34cz
34da
34db
34dc
34dd
34de
34df
34dg
34dh
34di
34dj
34dk
34dl
34dm
34dn
34do
34dp
34dq
34dr
34ds
34dt
34du
34dv
34dw
34dx
34dy
34dz
34ea
34eb
34ec
34ed
34ee
34ef
34eg
34eh
34ei
34ej
34ek
34el
34em
34en
34eo
34ep
34eq
34er
34es
34et
34eu
34ev
34ew
34ex
34ey
34ez
34fa
34fb
34fc
34fd
34fe
34ff
34fg
34fh
34fi
34fj
34fk
34fl
34fm
34fn
34fo
34fp
34fq
34fr
34fs
34ft
34fu
34fv
34fw
34fx
34fy
34fz
34ga
34gb
34gc
34gd
34ge
34gf
34gg
34gh
34gi
34gj
34gk
34gl
34gm
34gn
34go
34gp
34gq
34gr
34gs
34gt
34gu
34gv
34gw
34gx
34gy
34gz
34ha
34hb
34hc
34hd
34he
34hf
34hg
34hh
34hi
34hj
34hk
34hl
34hm
34hn
34ho
34hp
34hq
34hr
34hs
34ht
34hu
34hv
34hw
34hx
34hy
34hz
34ia
34ib
34ic
34id
34ie
34if
34ig
34ih
34ii
34ij
34ik
34il
34im
34in
34io
34ip
34iq
34ir
34is
34it
34iu
34iv
34iw
34ix
34iy
34iz
34ja
34jb
34jc
34jd
34je
34jf
34jg
34jh
34ji
34jj
34jk
34jl
34jm
34jn
34jo
34jp
34jq
34jr
34js
34jt
34ju
34jv
34jw
34jx
34jy
34jz
34ka
34kb
34kc
34kd
34ke
34kf
34kg
34kh
34ki
34kj
34kk
34kl
34km
34kn
34ko
34kp
34kq
34kr
34ks
34kt
34ku
34kv
34kw
34kx
34ky
34kz
34la
34lb
34lc
34ld
34le
34lf
34lg
34lh
34li
34lj
34lk
34ll
34lm
34ln
34lo
34lp
34lq
34lr
34ls
34lt
34lu
34lv
34lw
34lx
34ly
34lz
34ma
34mb
34mc
34md
34me
34mf
34mg
34mh
34mi
34mj
34mk
34ml
34mm
34mn
34mo
34mp
34mq
34mr
34ms
34mt
34mu
34mv
34mw
34mx
34my
34mz
34na
34nb
34nc
34nd
34ne
34nf
34ng
34nh
34ni
34nj
34nk
34nl
34nm
34nn
34no
34np
34nq
34nr
34ns
34nt
34nu
34nv
34nw
34nx
34ny
34nz
34oa
34ob
34oc
34od
34oe
34of
34og
34oh
34oi
34oj
34ok
34ol
34om
34on
34oo
34op
34oq
34or
34os
34ot
34ou
34ov
34ow
34ox
34oy
34oz
34pa
34pb
34pc
34pd
34pe
34pf
34pg
34ph
34pi
34pj
34pk
34pl
34pm
34pn
34po
34pp
34pq
34pr
34ps
34pt
34pu
34pv
34pw
34px
34py
34pz
34qa
34qb
34qc
34qd
34qe
34qf
34qg
34qh
34qi
34qj
34qk
34ql
34qm
34qn
34qo
34qp
34qq
34qr
34qs
34qt
34qu
34qv
34qw
34qx
34qy
34qz
34ra
34rb
34rc
34rd
34re
34rf
34rg
34rh
34ri
34rj
34rk
34rl
34rm
34rn
34ro
34rp
34rq
34rr
34rs
34rt
34ru
34rv
34rw
34rx
34ry
34rz
34sa
34sb
34sc
34sd
34se
34sf
34sg
34sh
34si
34sj
34sk
34sl
34sm
34sn
34so
34sp
34sq
34sr
34ss
34st
34su
34sv
34sw
34sx
34sy
34sz
34ta
34tb
34tc
34td
34te
34tf
34tg
34th
34ti
34tj
34tk
34tl
34tm
34tn
34to
34tp
34tq
34tr
34ts
34tt
34tu
34tv
34tw
34tx
34ty
34tz
34ua
34ub
34uc
34ud
34ue
34uf
34ug
34uh
34ui
34uj
34uk
34ul
34um
34un
34uo
34up
34uq
34ur
34us
34ut
34uv
34uw
34ux
34uy
34uz
34va
34vb
34vc
34vd
34ve
34vf
34vg
34vh
34vi
34vj
34vk
34vl
34vm
34vn
34vo
34vp
34vq
34vr
34vs
34vt
34vu
34vv
34vw
34vx
34vy
34vz
34wa
34wb
34wc
34wd
34we
34wf
34wg
34wh
34wi
34wj
34wk
34wl
34wm
34wn
34wo
34wp
34wq
34wr
34ws
34wt
34wu
34wv
34ww
34wx
34wy
34wz
34xa
34xb
34xc
34xd
34xe
34xf
34xg
34xh
34xi
34xj
34xk
34xl
34xm
34xn
34xo
34xp
34xq
34xr
34xs
34xt
34xu
34xv
34xw
34xx
34xy
34xz
34ya
34yb
34yc
34yd
34ye
34yf
34yg
34yh
34yi
34yj
34yk
34yl
34ym
34yn
34yo
34yp
34yq
34yr
34ys
34yt
34yu
34yv
34yw
34yx
34yy
34yz
34za
34zb
34zc
34zd
34ze
34zf
34zg
34zh
34zi
34zj
34zk
34zl
34zm
34zn
34zo
34zp
34zq
34zr
34zs
34zt
34zu
34zv
34zw
34zx
34zy
34zz

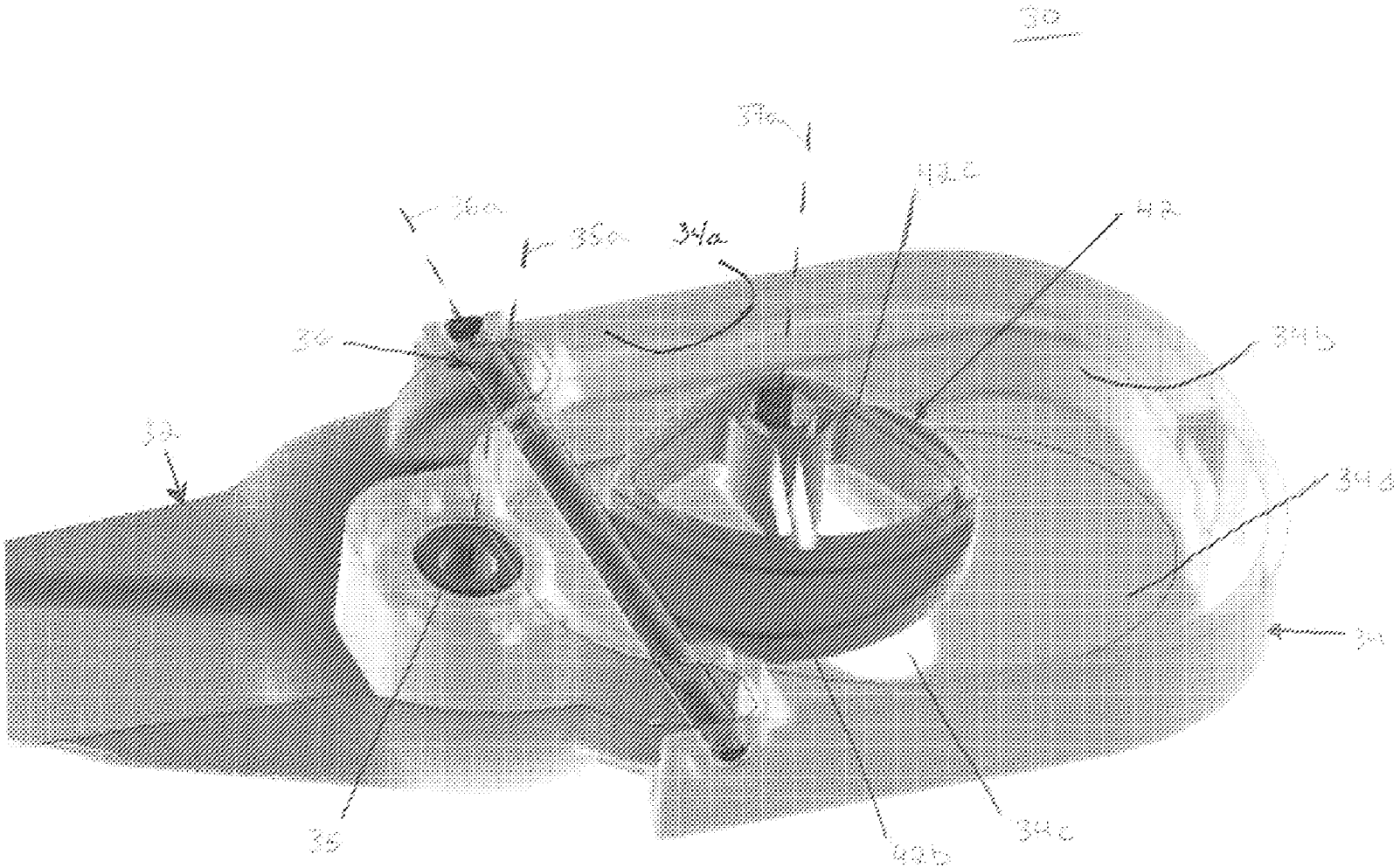
34b
34a
34c
34d
34e
34f
34g
34h
34i
34j
34k
34l
34m
34n
34o
34p
34q
34r
34s
34t
34u
34v
34w
34x
34y
34z
34aa
34ab
34ac
34ad
34ae
34af
34ag
34ah
34ai
34aj
34ak
34al
34am
34an
34ao
34ap
34aq
34ar
34as
34at
34au
34av
34aw
34ax
34ay
34az
34ba
34bb
34bc
34bd
34be
34bf
34bg
34bh
34bi
34bj
34bk
34bl
34bm
34bn
34bo
34bp
34bq
34br
34bs
34bt
34bu
34bv
34bw
34bx
34by
34bz
34ca
34cb
34cc
34cd
34ce
34cf
34cg
34ch
34ci
34cj
34ck
34cl
34cm
34cn
34co
34cp
34cq
34cr
34cs
34ct
34cu
34cv
34cw
34cx
34cy
34cz
34da
34db
34dc
34dd
34de
34df
34dg
34dh
34di
34dj
34dk
34dl
34dm
34dn
34do
34dp
34dq
34dr
34ds
34dt
34du
34dv
34dw
34dx
34dy
34dz
34ea
34eb
34ec
34ed
34ee
34ef
34eg
34eh
34ei
34ej
34ek
34el
34em
34en
34eo
34ep
34eq
34er
34es
34et
34eu
34ev
34ew
34ex
34ey
34ez
34fa
34fb
34fc
34fd
34fe
34ff
34fg
34fh
34fi
34fj
34fk
34fl
34fm
34fn
34fo
34fp
34fq
34fr
34fs
34ft
34fu
34fv
34fw
34fx
34fy
34fz
34ga
34gb
34gc
34gd
34ge
34gf
34gg
34gh
34gi
34gj
34gk
34gl
34gm
34gn
34go
34gp
34gq
34gr
34gs
34gt
34gu
34gv
34gw
34gx
34gy
34gz
34ha
34hb
34hc
34hd
34he
34hf
34hg
34hh
34hi
34hj
34hk
34hl
34hm
34hn
34ho
34hp
34hq
34hr
34hs
34ht
34hu
34hv
34hw
34hx
34hy
34hz
34ia
34ib
34ic
34id
34ie
34if
34ig
34ih
34ii
34ij
34ik
34il
34im
34in
34io
34ip
34iq
34ir
34is
34it
34iu
34iv
34iw
34ix
34iy
34iz
34ja
34jb
34jc
34jd
34je
34jf
34jg
34jh
34ji
34jj
34jk
34jl
34jm
34jn
34jo
34jp
34jq
34jr
34js
34jt
34ju
34jv
34jw
34jx
34jy
34jz
34ka
34kb
34kc
34kd
34ke
34kf
34kg
34kh
34ki
34kj
34kk
34kl
34km
34kn
34ko
34kp
34kq
34kr
34ks
34kt
34ku
34kv
34kw
34kx
34ky
34kz
34la
34lb
34lc
34ld
34le
34lf
34lg
34lh
34li
34lj
34lk
34ll
34lm
34ln
34lo
34lp
34lq
34lr
34ls
34lt
34lu
34lv
34lw
34lx
34ly
34lz
34ma
34mb
34mc
34md
34me
34mf
34mg
34mh
34mi
34mj
34mk
34ml
34mm
34mn
34mo
34mp
34mq
34mr
34ms
34mt
34mu
34mv
34mw
34mx
34my
34mz
34na
34nb
34nc
34nd
34ne
34nf
34ng
34nh
34ni
34nj
34nk
34nl
34nm
34nn
34no
34np
34nq
34nr
34ns
34nt
34nu
34nv
34nw
34nx
34ny
34nz
34oa
34ob
34oc
34od
34oe
34of
34og
34oh
34oi
34oj
34ok
34ol
34om
34on
34oo
34op
34oq
34or
34os
34ot
34ou
34ov
34ow
34ox
34oy
34oz
34pa
34pb
34pc
34pd
34pe
34pf
34pg
34ph
34pi
34pj
34pk
34pl
34pm
34pn
34po
34pp
34pq
34pr
34ps
34pt
34pu
34pv
34pw
34px
34py
34pz
34qa
34qb
34qc
34qd
34qe
34qf
34qg
34qh
34qi
34qj
34qk
34ql
34qm
34qn
34qo
34qp
34qq
34qr
34qs
34qt
34qu
34qv
34qw
34qx
34qy
34qz
34ra
34rb
34rc
34rd
34re
34rf
34rg
34rh
34ri
34rj
34rk
34rl
34rm
34rn
34ro
34rp
34rq
34rr
34rs
34rt
34ru
34rv
34rw
34rx
34ry
34rz
34sa
34sb
34sc
34sd
34se
34sf
34sg
34sh
34si
34sj
34sk
34sl
34sm
34sn
34so
34sp
34sq
34sr
34ss
34st
34su
34sv
34sw
34sx
34sy
34sz
34ta
34tb
34tc
34td
34te
34tf
34tg
34th
34ti
34tj
34tk
34tl
34tm
34tn
34to
34tp
34tq
34tr
34ts
34tt
34tu
34tv
34tw
34tx
34ty
34tz
34ua
34ub
34uc
34ud
34ue
34uf
34ug
34uh
34ui
34uj
34uk
34ul
34um
34un
34uo
34up
34uq
34ur
34us
34ut
34uv
34uw
34ux
34uy
34uz
34va
34vb
34vc
34vd
34ve
34vf
34vg
34vh
34vi
34vj
34vk
34vl
34vm
34vn
34vo
34vp
34vq
34vr
34vs
34vt
34vu
34vv
34vw
34vx
34vy
34vz
34wa
34wb
34wc
34wd
34we
34wf
34wg
34wh
34wi
34wj
34wk
34wl
34wm
34wn
34wo
34wp
34wq
34wr
34ws
34wt
34wu
34wv
34ww
34wx
34wy
34wz
34xa
34xb
34xc
34xd
34xe
34xf
34xg
34xh
34xi
34xj
34xk
34xl
34xm
34xn
34xo
34xp
34xq
34xr
34xs
34xt
34xu
34xv
34xw
34xx
34xy
34xz
34ya
34yb
34yc
34yd
34ye
34yf
34yg
34yh
34yi
34yj
34yk
34yl
34ym
34yn
34yo
34yp
34yq
34yr
34ys
34yt
34yu
34yv
34yw
34yx
34yy
34yz
34za
34zb
34zc
34zd
34ze
34zf
34zg
34zh
34zi
34zj
34zk
34zl
34zm
34zn
34zo
34zp
34zq
34zr
34zs
34zt
34zu
34zv
34zw
34zx
34zy
34zz

ARTICULATED WALKING TOY DEVICE

CROSS-REFERENCE TO RELATED APPLICATIONS

This patent application claims priority to U.S. Provisional Patent Application No. 60/732,966, filed Nov. 3, 2005, entitled "Articulated Walking Toy Device", the disclosure of which is incorporated herein by reference.

BACKGROUND OF THE INVENTION

This invention generally relates to powered, motive toys and, in particular, to articulated walking toys.

While articulated walking toys are generally known, it is believed that an articulated toy with an alternate motive mechanism for providing a more anatomic-like walking movement would be desirable.

BRIEF SUMMARY OF THE INVENTION

Briefly stated, the present invention is an articulated walking toy device configured for movement across a surface. The toy device comprises a frame and a plurality of leg assemblies movably coupled with the frame. Each leg assembly includes a leg member configured to rotate with respect to the frame about separate first and second axes. The first and second axes are at least generally transverse to one another. A drive mechanism is operatively engaged with the plurality of leg assemblies so as to actuate each of the leg members to rotate about the first and second axes in a like, predetermined, repeatable cycle of movement. At least some of the leg members are out of phase with other leg members to produce an anatomic-like gait of the toy device upon actuation of the drive mechanism.

In another aspect, the present invention is an articulated device configured to walking movement across a surface. The device comprises a frame and a plurality of leg assemblies engaged with the frame. Each leg assembly includes a leg member coupled with the frame for movement with respect to the frame in at least two directions transverse to one another. Each leg assembly further includes at least two cams operably coupled with the leg member so as to move the leg member in different directions with respect to the frame. A drive mechanism is drivingly engaged with each of the plurality of leg assemblies through at least the two cams of each leg assembly so as to cause each of the leg members of the leg assemblies to move in the at least two different directions in a like, predetermined, repeatable cycle of movement of each leg member. Movement of at least some of the plurality of the leg members is unsynchronized with movement of others of the plurality of the leg members, such that the plurality of leg members produce an anatomic-like gait of the device across the surface.

BRIEF DESCRIPTION OF THE SEVERAL VIEW OF THE DRAWINGS

The following detailed description of a preferred embodiment of the invention will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings:

FIG. 4 is a perspective view of a leg assembly of the toy device of FIGS. 1-3 shown in a down, propulsion position;

FIG. 5 is a perspective view of the leg assembly of FIG. 4 shown in an up, return position;

FIGS. 6-9 are perspective views of a base and first and second cams of a first cam member of the leg assembly of FIGS. 4-5 in various stages of walking;

FIGS. 10-15 are perspective sectional views of the base and second cam of the first cam member of the leg assembly of FIGS. 6-9 being shown in various stages of walking.

FIG. 17 is an elevation view of the device of FIG. 1 showing a complete cycle of movement of the middle one of the legs.

DETAILED DESCRIPTION OF THE INVENTION

Figure 1:
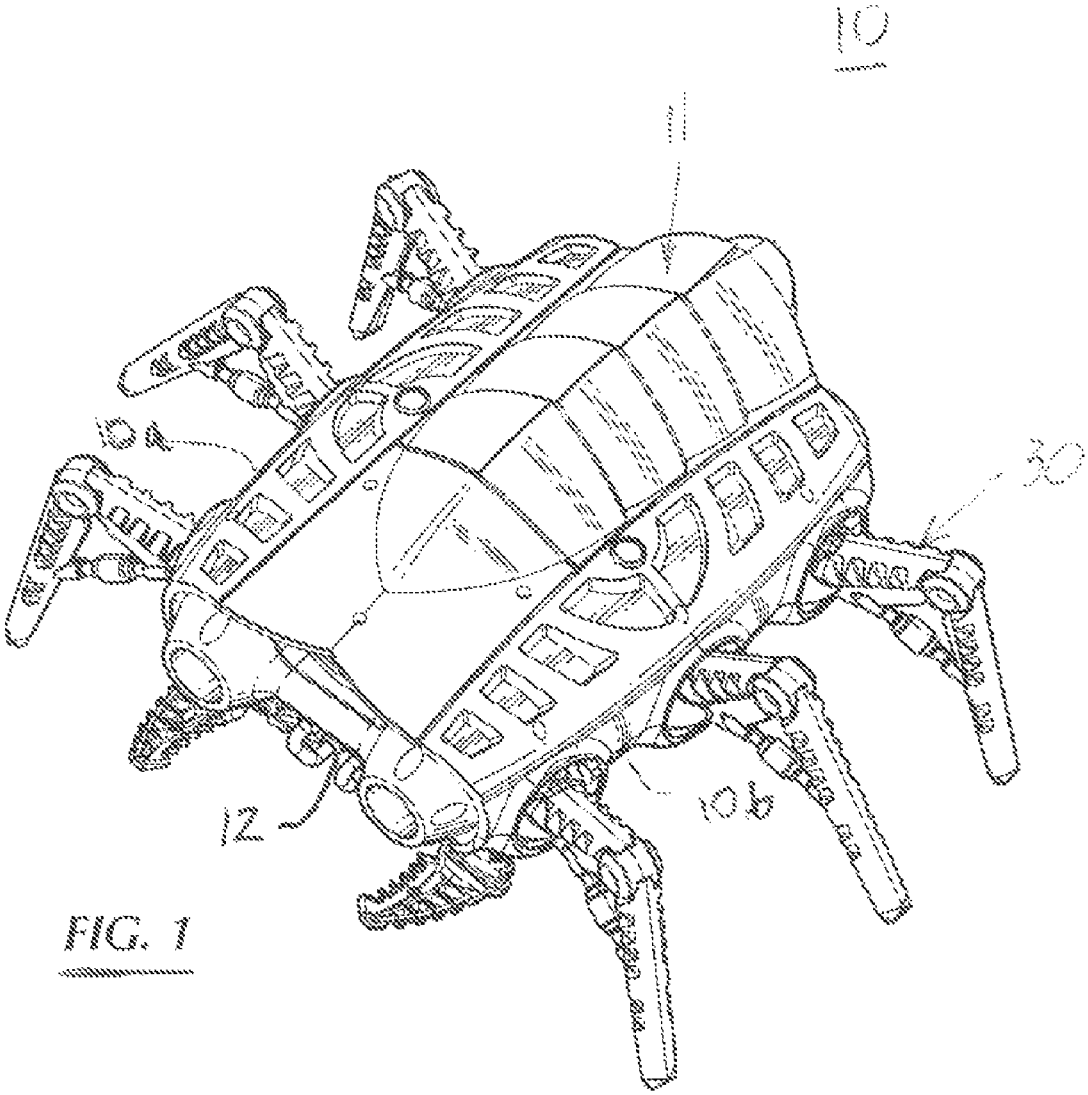
FIG. 1 is an upper perspective view of the front and left side of an articulated toy device in accordance with the present invention in the form of an insect-like create with six motive legs.

Certain terminology is used in the following description for convenience only and is not limiting. The words "right," "left," "upper," and "lower" designate directions in the drawings to which reference is made. The terminology includes the words above specifically mentioned, derivatives thereof, and words of similar import.

Referring to the drawings in detail, wherein like numerals indicate like elements throughout, there is shown in the figures a preferred embodiment of an articulated walking toy device, indicated generally at 10, in accordance with the present invention. The toy device 10 walks along a surface (not shown) by cyclically moving each of a plurality of leg assemblies 30, as will be described in more detail below. Preferably, the toy device 10 includes six leg assemblies 30, three leg assemblies 30 on each lateral side 10*a*, 10*b* of the device 10 (and its frame 12), to mimic an insect-like creature. It is within the scope of the present invention that there be more or less than six leg assemblies 30, provided the toy device 10 can still function to propel or support and propel the toy device 10, as described herein. Additionally, it is intended that the toy device 10 includes a decorative outer housing or body one example of which is indicated generally at 11 in FIG. 1. Body 11 is decorated in a bug-like, and/or monster-like-appearance that is visually attractive to the user.

Figure 2:
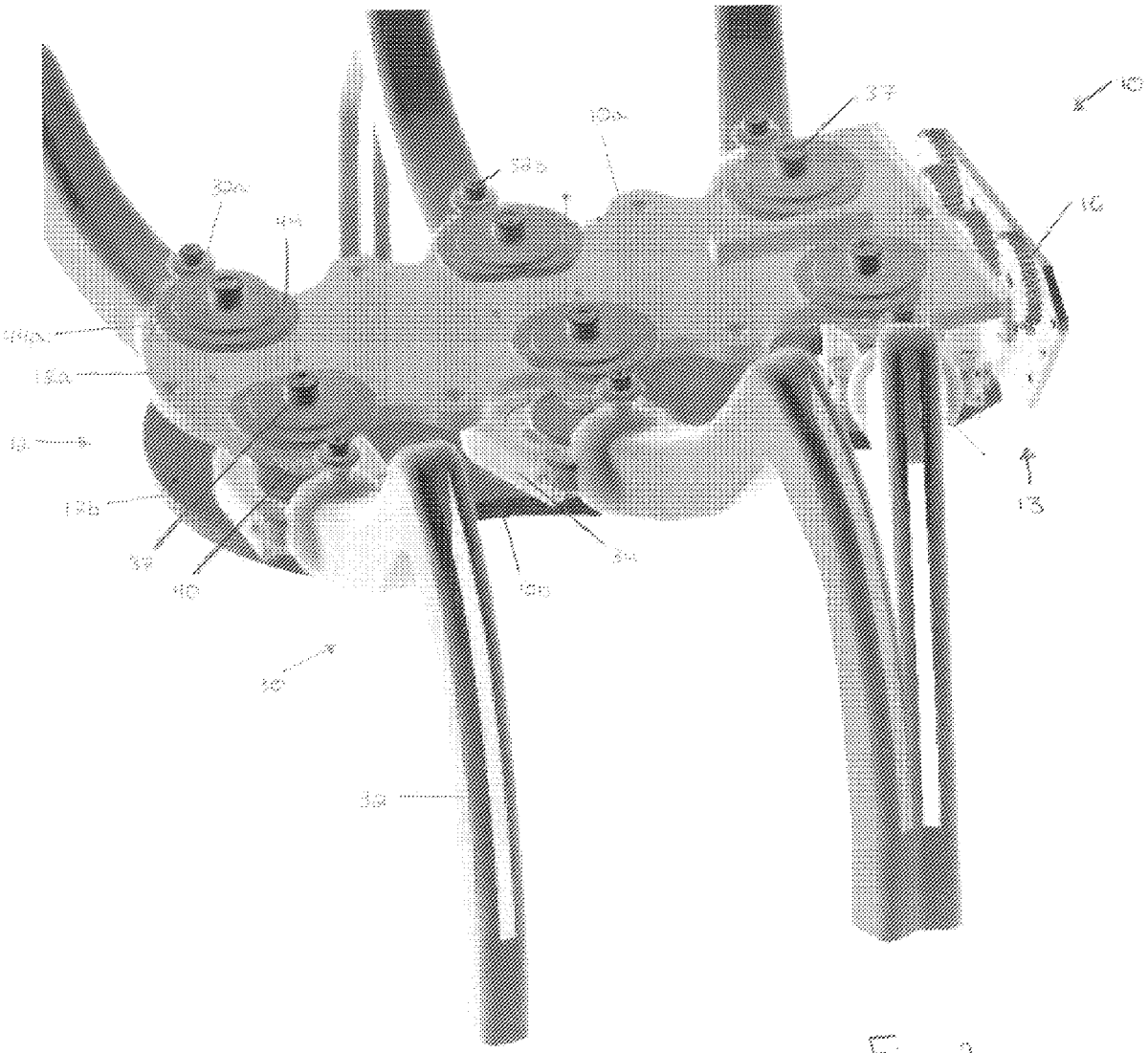
FIG. 2 is an upper perspective view of one end and one lateral side of the device of FIG. 1 with the body and other superfluous elements such as a gearbox or transmission housing removed to reveal a frame of two parts with six leg assemblies mounted therebetween.
Figure 3:
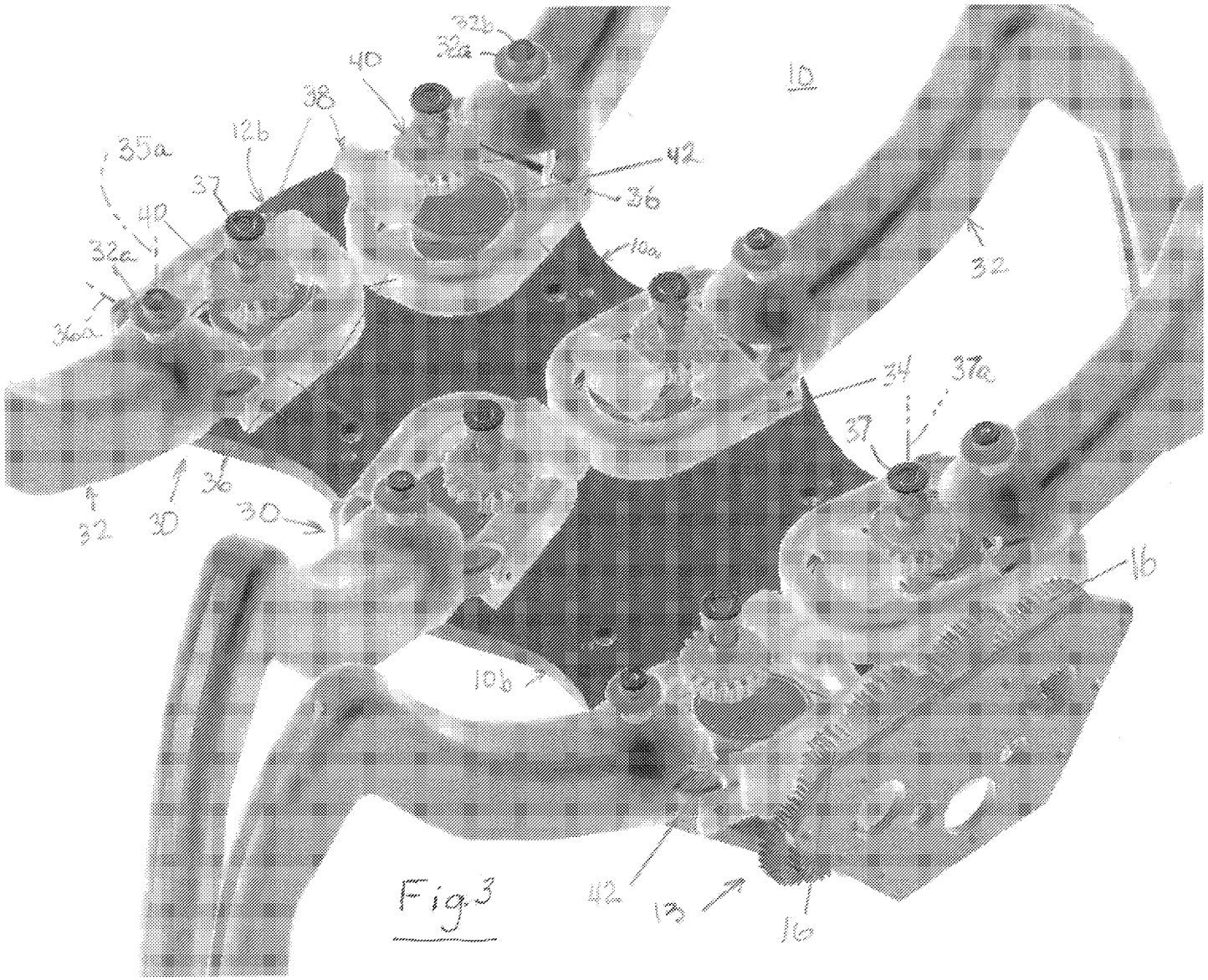
FIG. 3 is an upper perspective view of the opposing or remaining end and lateral side of the device of FIG. 2 with an upper plate of the frame and a cam element of each of the leg assemblies additionally removed, to reveal twin drive trains on the first and second opposing lateral sides of the toy device and chassis.
Figure 9:
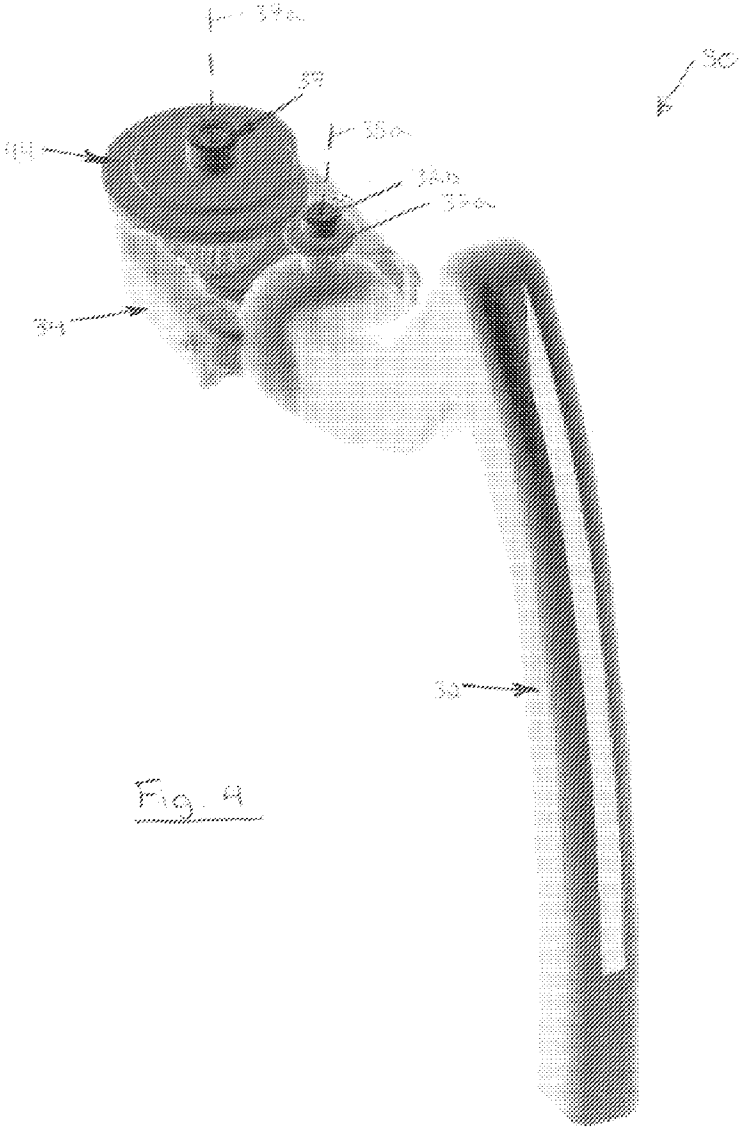
Figure 14:
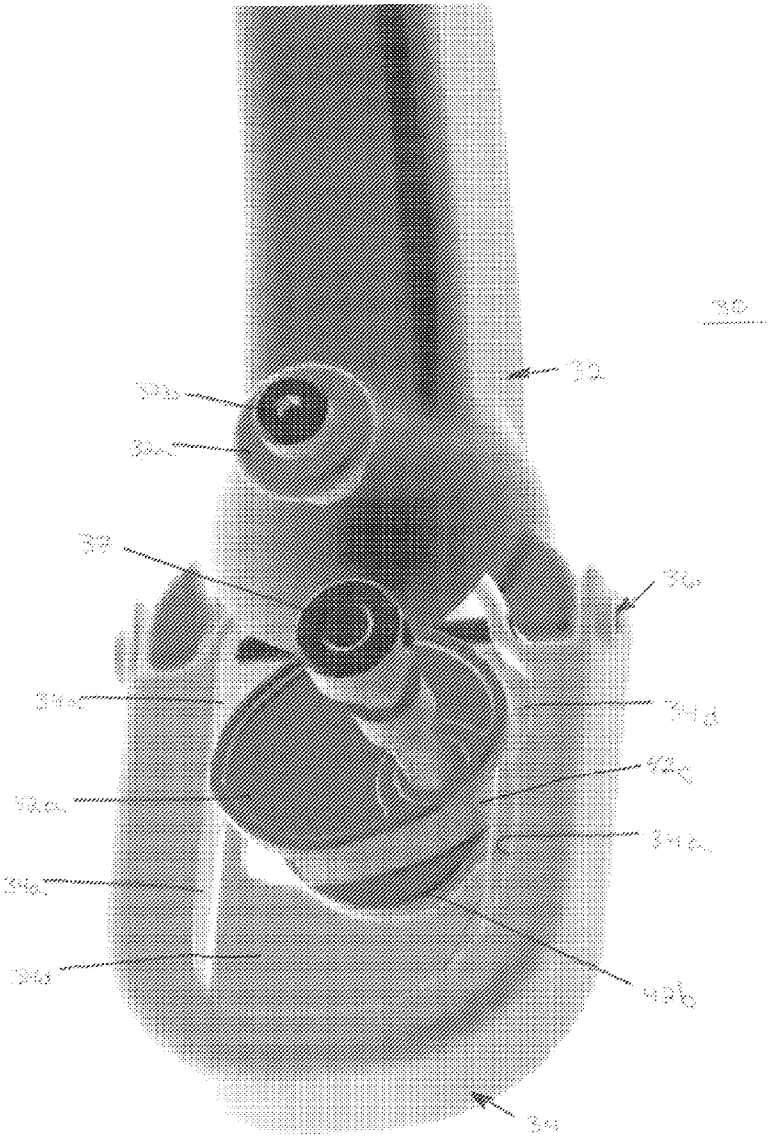
Figure 8:
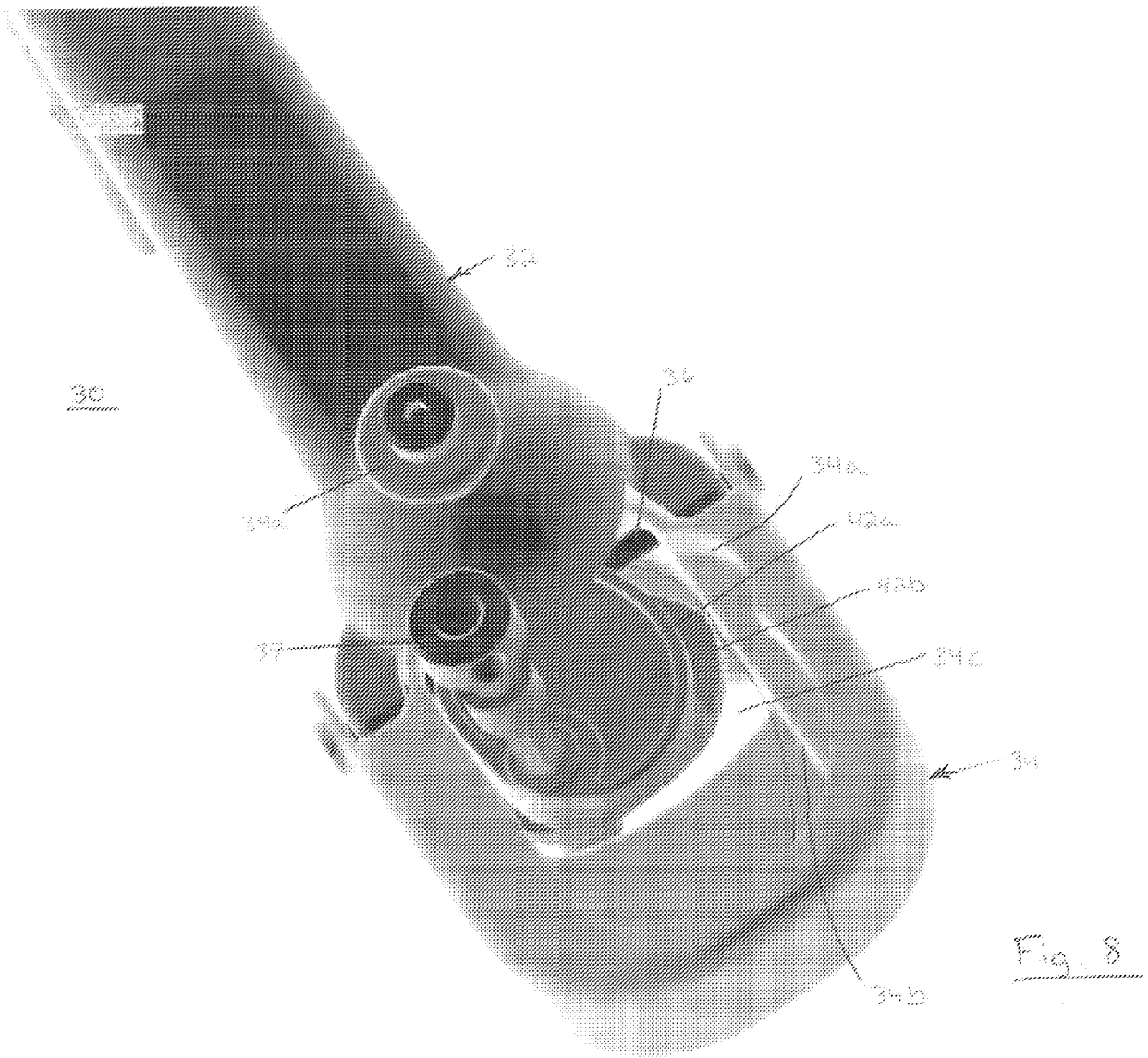
Figure 9:
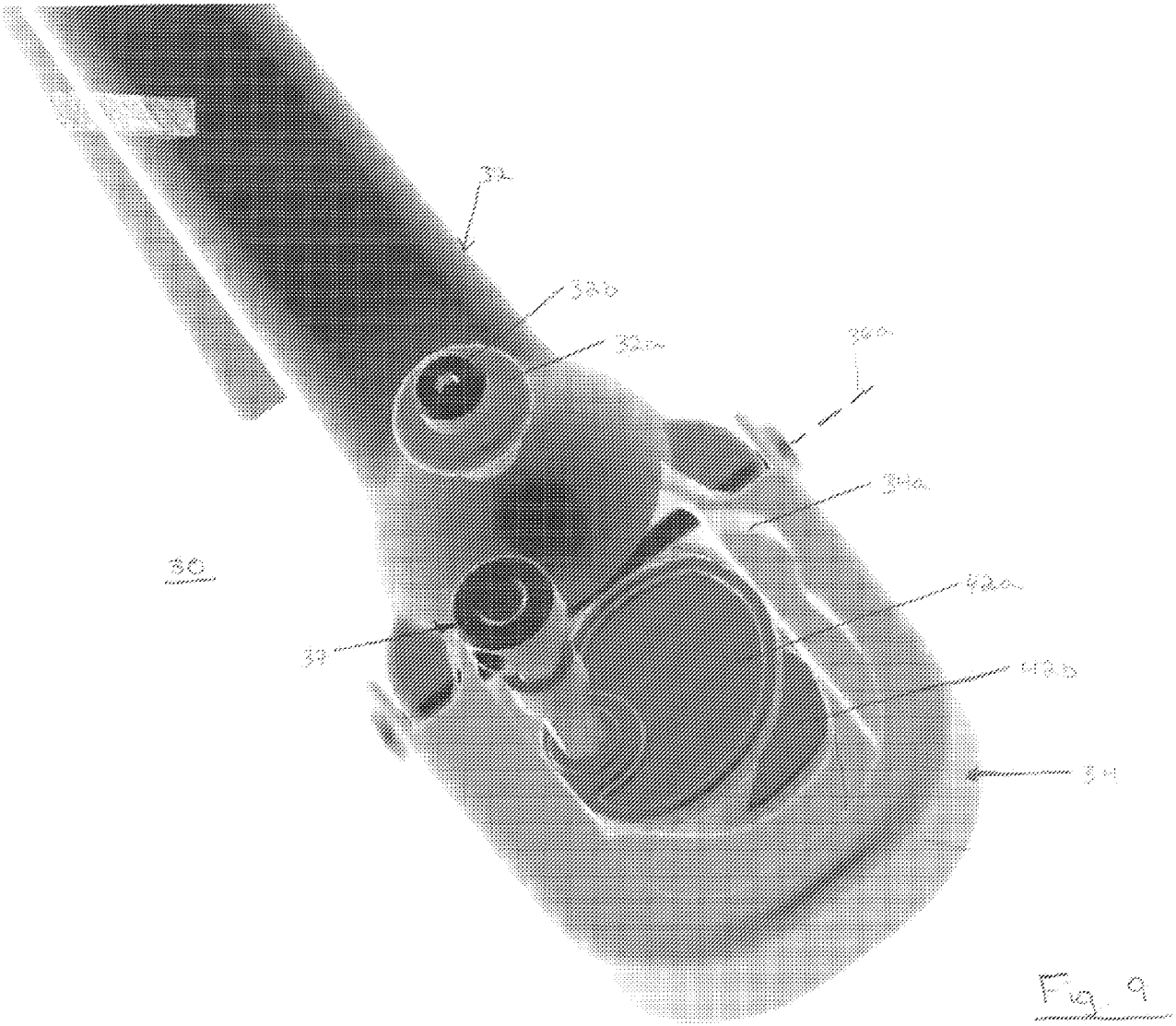
Figure 11:
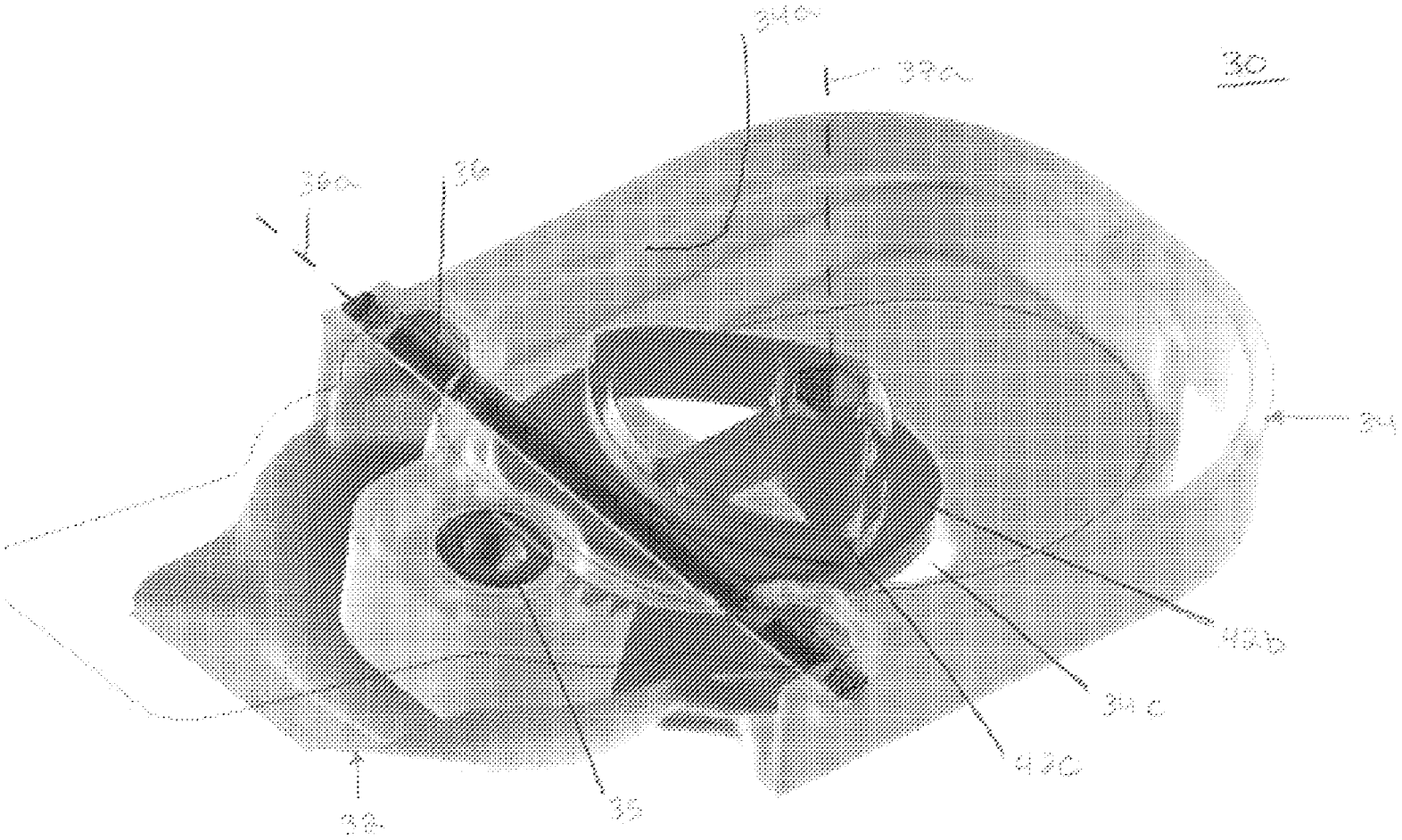

Referring to FIGS. 1-3, the toy device 10 includes a frame 12 having a top, first plate 12*a* and a bottom, second plate 12*b*. The plurality of leg assemblies 30 are coupled with the frame 12, preferably be being sandwiched between the first and second plates 12*a*, 12*b*. Leg shafts 37 extend between the first and second plates 12*a*, 12*b*, and preferably, a portion of each leg shaft 37 extends above the first plate 12*a* of the frame 12 and supports a second cam member 44 of the leg assembly 30 for rotation. The second cam member 44 will be described in more detail below.

Figure 18:
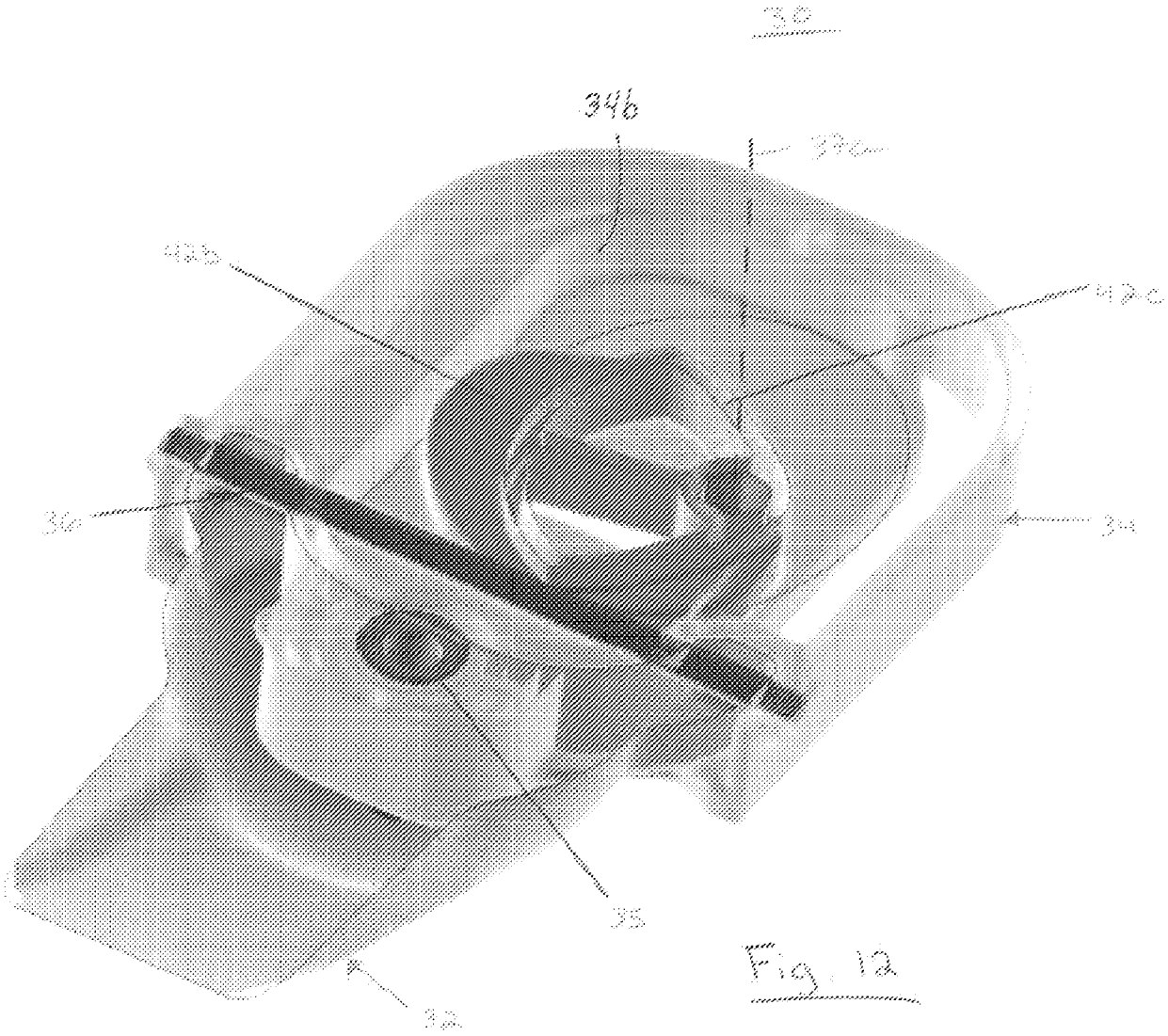
FIGS. 18-23 depict the unsynchronized movements of the legs on one lateral side of the device.
Figure 13:
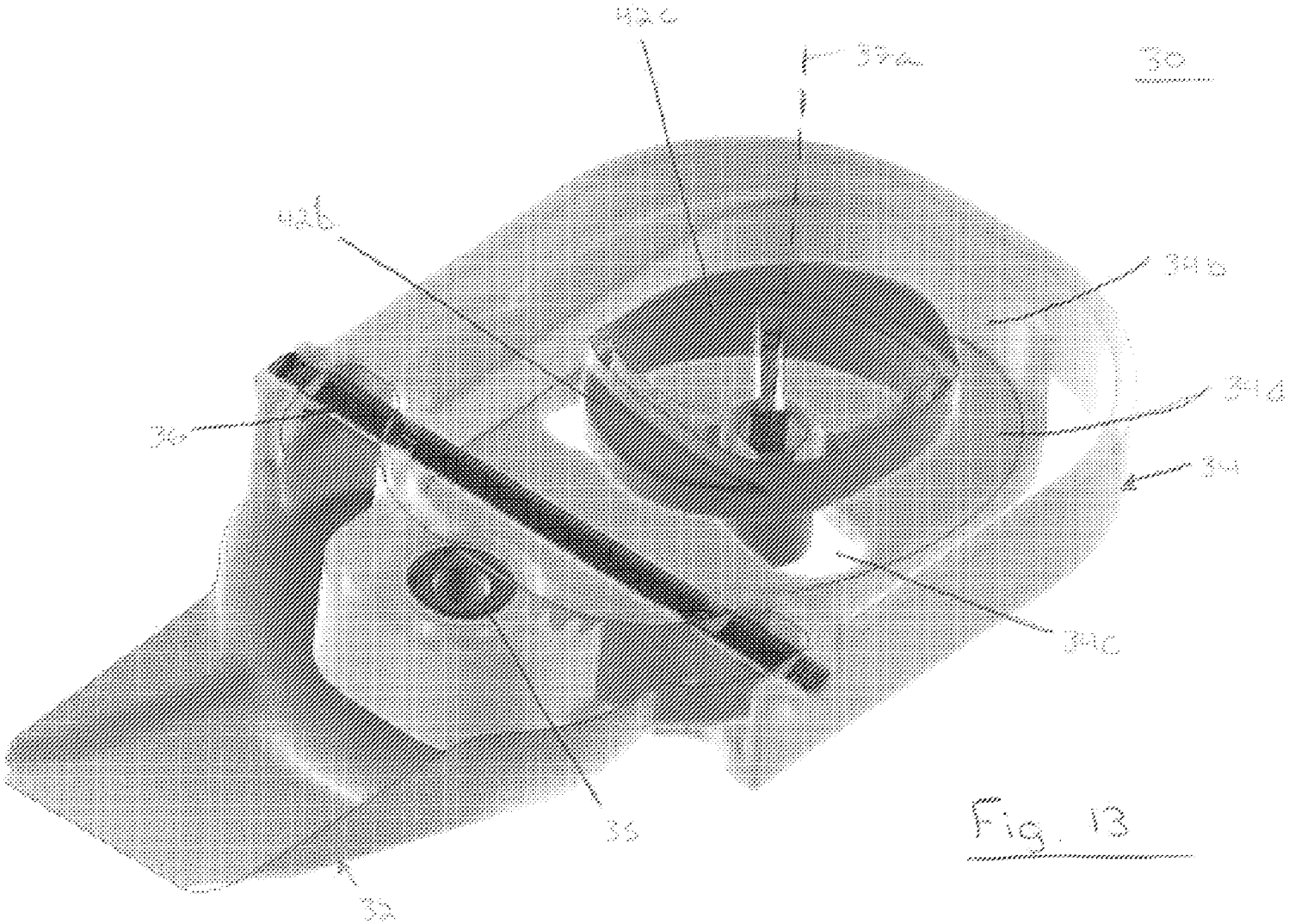
Figure 14:
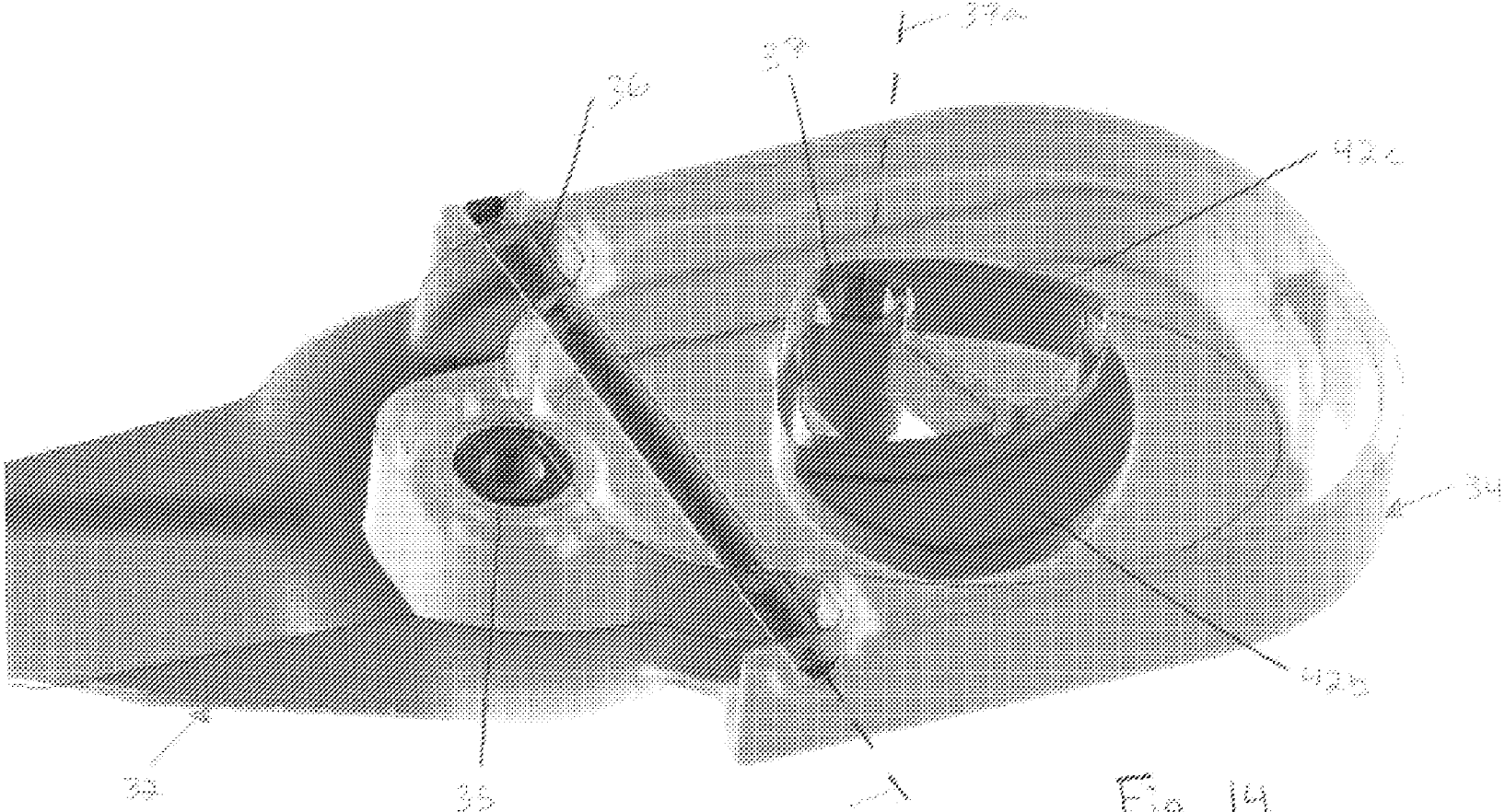
Figure 15:
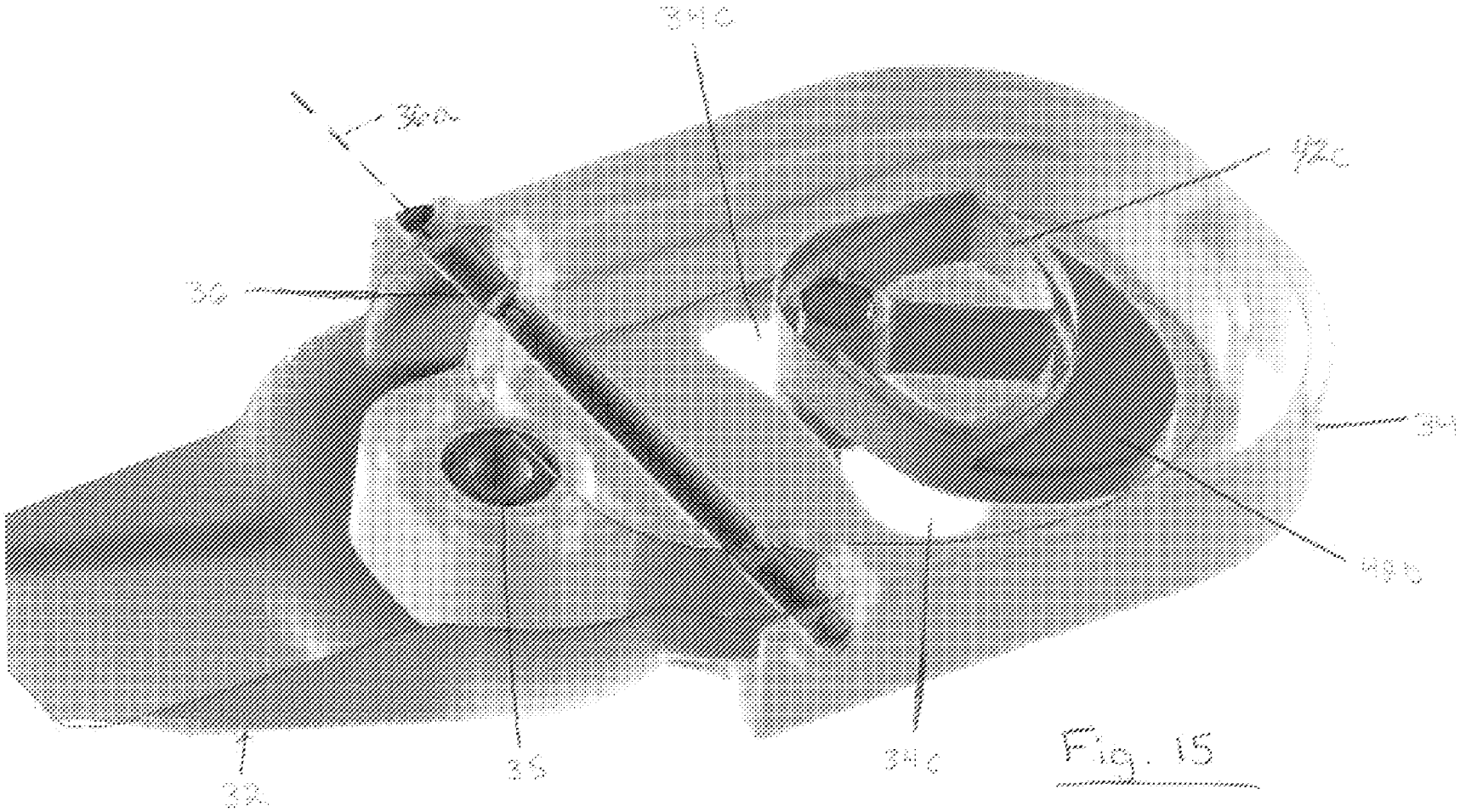
Figure 16:
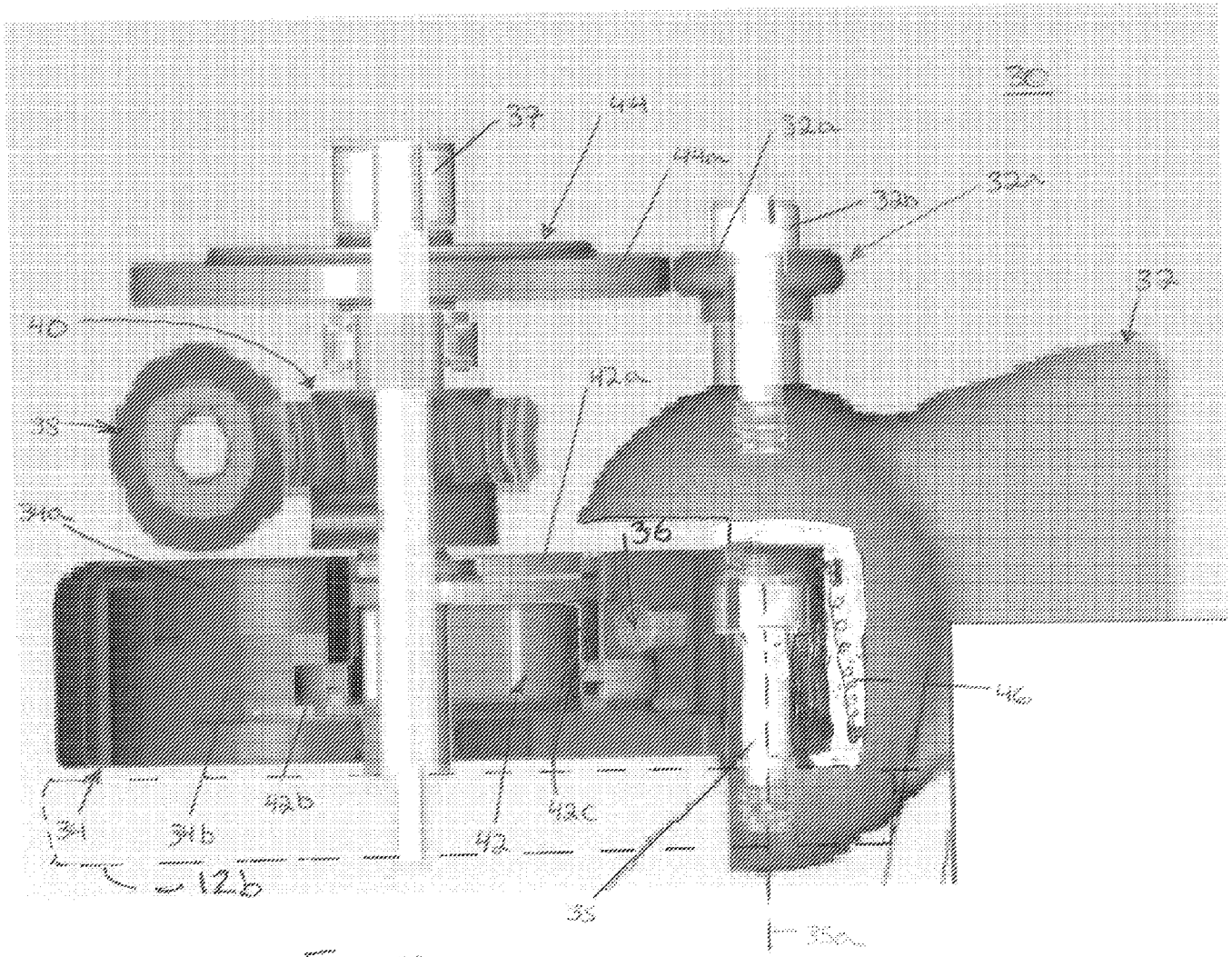
FIG. 16 is a partially sectioned side elevation view of the leg assembly of FIGS. 4-15.
Figure 14:
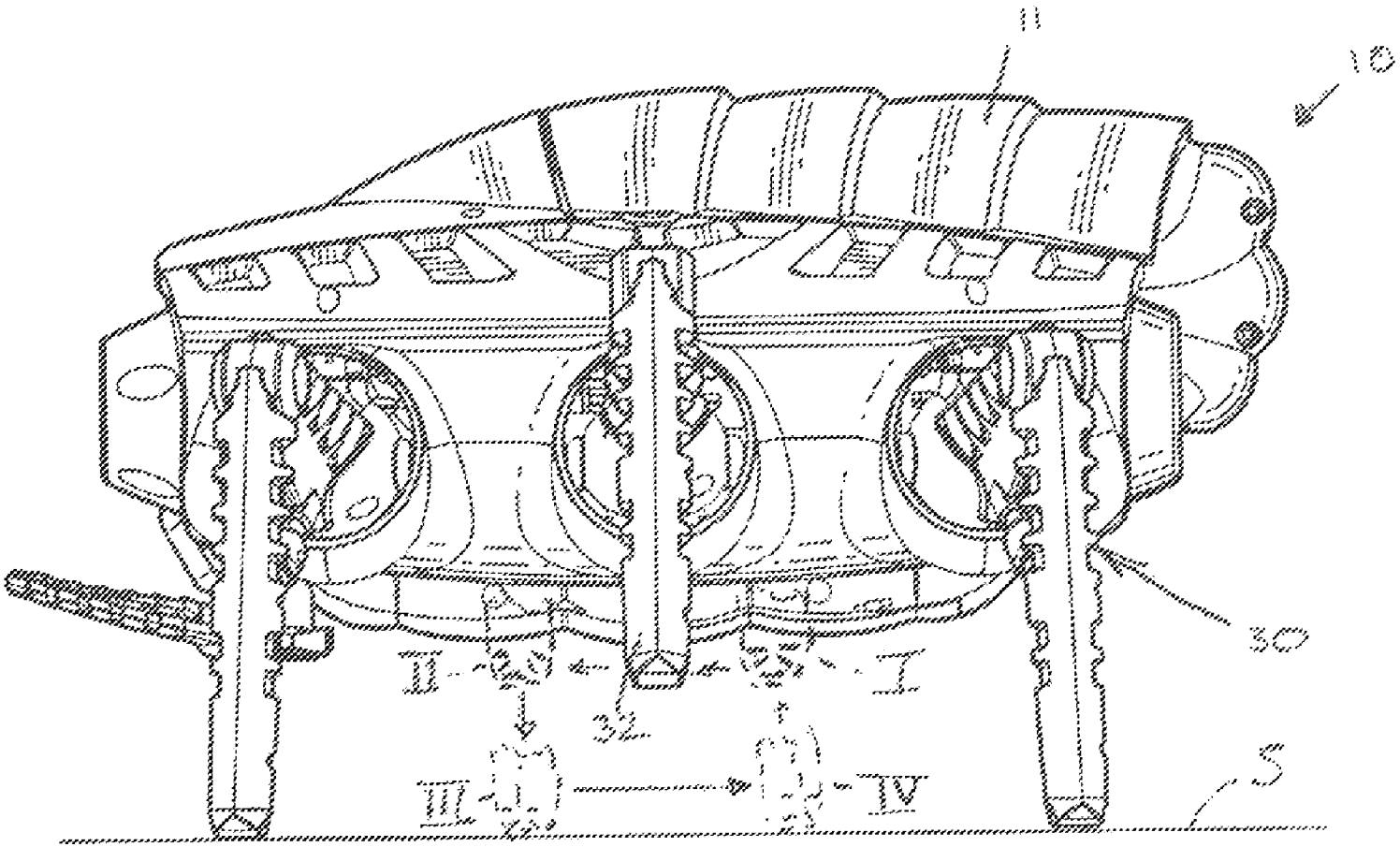
Figure 18:
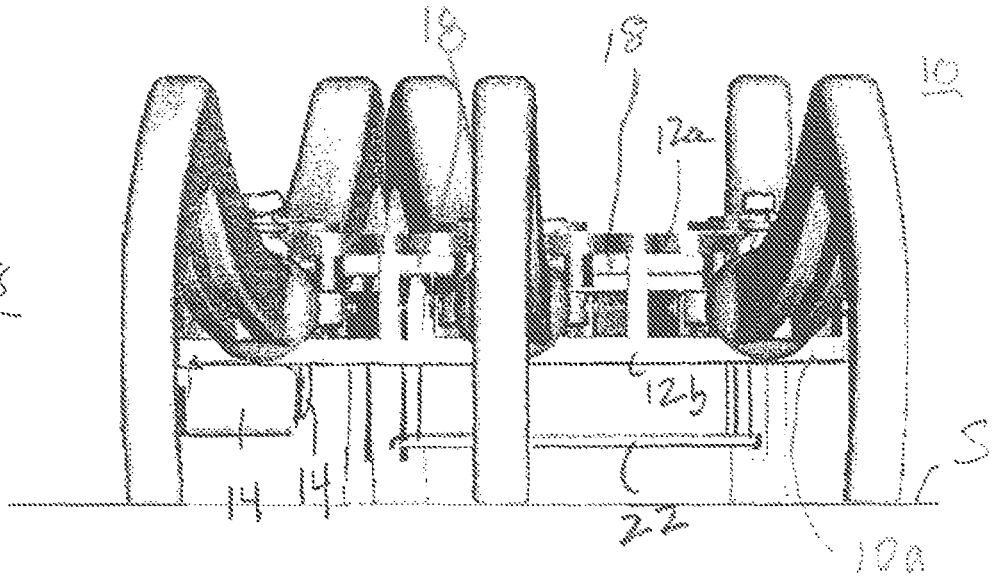
Figure 19:
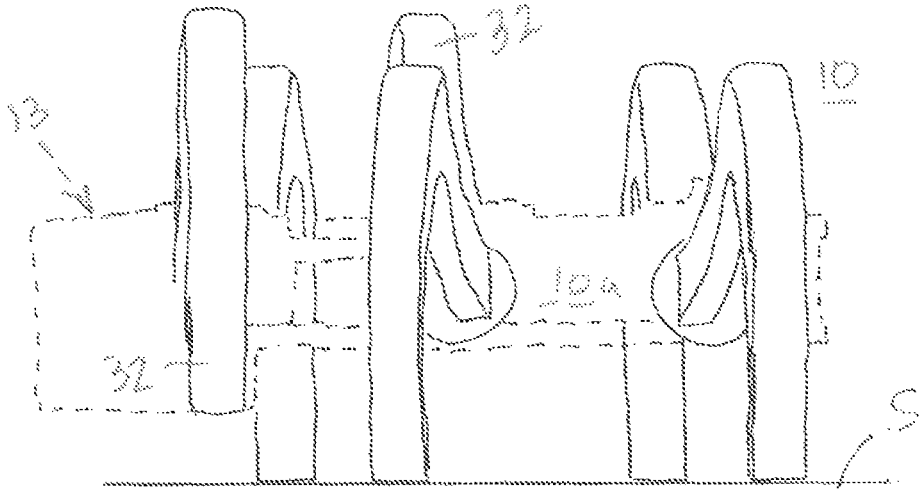
Figure 20:
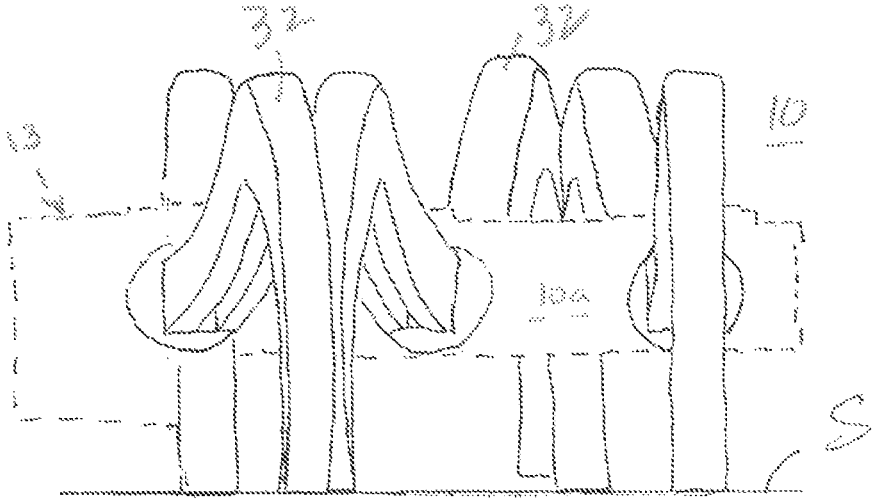
Figure 21:
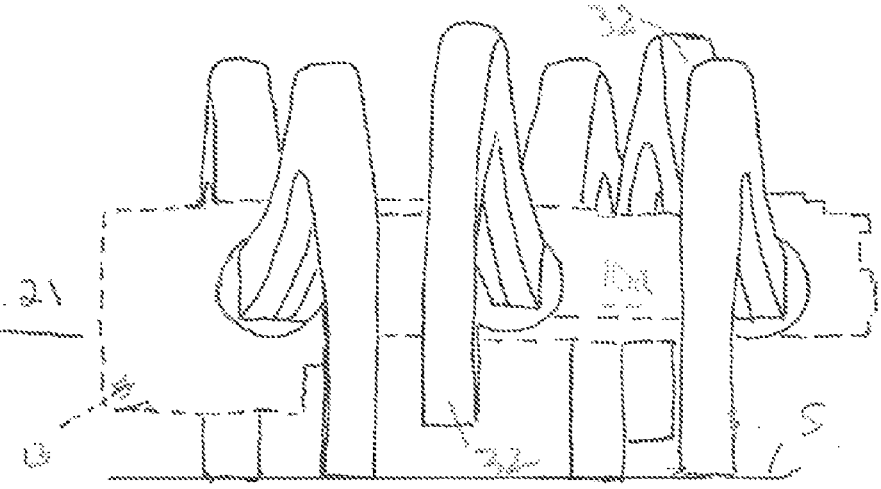
Figure 22:
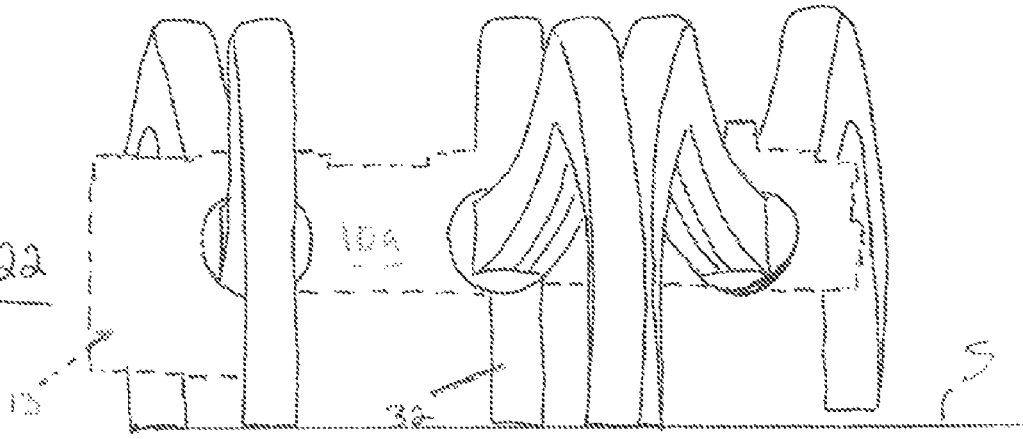
Figure 23:
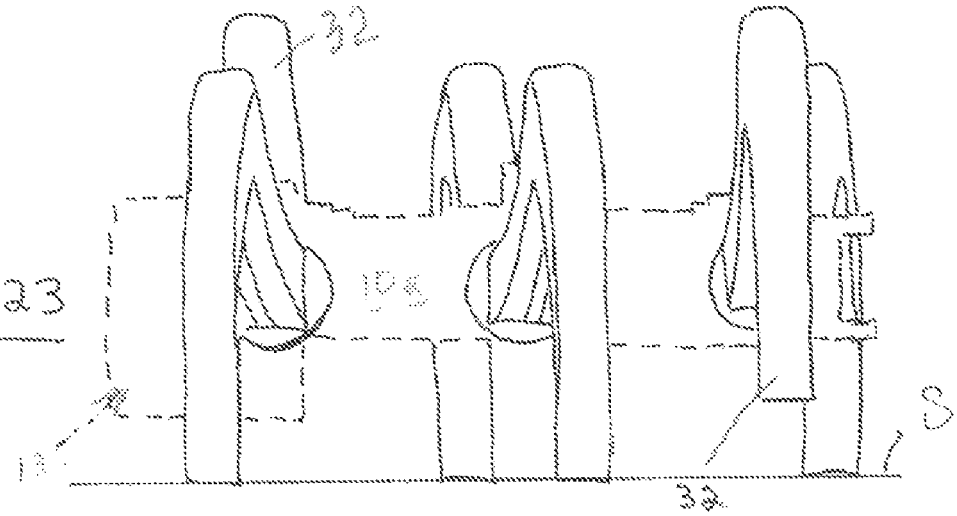

Referring to FIG. 3, the toy device 10 is shown with the first plate 12*a* and the second cam members 44 removed to expose part of a drive mechanism of the toy device 10 indicated generally at and other portions of the leg assemblies 30. The toy device 10 preferably includes a drive mechanism indicated generally at 13, which preferably includes two independent drives that are mechanical mirror images of one another, on either lateral side 10*a*, 10*b* of the device 10. Each drive preferably includes a reversible motor 13 (see FIG. 18) for driving each of the three leg assemblies 30 on one of the lateral sides 10*a*, 10*b*. Each motor 14 engages with and drives a conventional reduction gear train portion of the mechanism 13 indicated generally at 16, which drives the wheel assemblies 30 through longitudinally extending drive shafting 18 (again, indicated in FIG. 18). Each motor 14 is rotatably coupled through the reduction gear train 16 and shafting 18 with three worms 38, one for each of the leg assemblies 30 of that lateral side of the device 10. Each worm 38 is engaged with and drives a worm gear 40 of the respective leg assembly 30.

The construction of each leg assembly 30 is preferably the same, although details and operation might vary from that of the described embodiment. Each leg assembly 30 include a leg member 32 configured to rotate with respect to the frame 12 about separate first and second axes as will be described. Each leg member 32 is actuated by the drive mechanism 13 to rotate about the two axes in a like, predetermined, repeatable cycle of movement. The phases of the cycles of the leg members are suggestedly varied with respect to one another to unsynchronize the movements of each leg assembly 30 and at least its immediately adjoining leg assembly(-ies) 30 to prevent all the legs assemblies or even adjoining pairs of leg assemblies on either lateral side of the toy device from moving in parallel and so as more faithfully mimic an anatomic gait. Accordingly, one leg assembly 30 will be described, the description applying to the other leg assemblies 30.

Referring to FIGS. 3-16, each depicted leg assembly 30 includes a base member 34 supporting the leg member 32 for rotation about the two separate axes with respect to the frame 12. As will be described, the two axes are at least generally transverse to one another sufficiently to provide each leg member 32 with freedom of rotation in at least two directions. The leg member 32 is preferably generally L-shaped so that the leg members 32 of the various leg assemblies 30 extend generally outwardly and downwardly from the frame 12 in order to support the frame 12 above a support surface S.

Referring now to FIGS. 3 and 6-16, rotatably fixed with each worm gear 40 is a first cam member 42 with first and second cams 42*a*, 42*b* respectively, and the second cam member 44 with a third cam 44*a* such that rotation of the gear 40 causes simultaneous rotation of the coupled together cam members 42, 44 and cams 42*a*, 42*b*, 44*a*. The worm gear 40 and cam members 42-44 may be made as separate pieces and keyed or otherwise fixed together to rotate in unison or they may be keyed to the leg shaft and the leg shaft rotated on the frame 12. There may be three separate cam members instead of two or all three cams could be combined in a single member with or without the worm gear 40. The three cams 42*a*, 42*b*, 44*a* all rotate together about the central axis 37*a* of leg shaft 37 but need not be so linked or arranged.

The first cam member 42 is preferably captured between the first and second plates 12*a*, 12*b*. The first cam 42*a* and second cam 42*b* are preferably disposed in a stacked manner with the first cam 42*a* atop the second cam 42*b* in the figures. The order of the cams could be reversed, however. The first cam member 42 is situated within a channel 34*d* in the base member 34 of each leg assembly 30. Referring generally to FIGS. 3-16, the base member 34 of each assembly 30 is preferably pivotally engaged with the second plate 12*b* of the frame 12 at a pivot 34 (see FIGS. 10-16) and further coupled to the frame 12 by the leg shaft 37 which passes through a generally arcuate slot 34*c* (best seen in FIGS. 10-11, 13 and 15) in the bottom of the base member 34, and which is offset from the pivot 35. Coupled to the frame 12 in this manner, the base member 34 pivots horizontally forward and rearward (with respect to the longitudinal direction of the frame 12 and device 10) about the pivot 35 and its central axis 35*a* by rotational motion of the first and second cams 42*a*, 42*b* within the channel 34*d* of the base member 34.

Specifically, motion of the base member 34 is accomplished as depicted in FIGS. 6-15. The first cam 42*a* of first cam member 42 is fully depicted in each of FIGS. 6-9. The second cam 42*b* of the first cam member 42 is fully depicted in FIGS. 10-15 together with a portion of a web or spacer 42*c* which supports the first cam 42*a* over the second cam 42*b*. The first cam 42*a* preferably interacts with a first follower surface 34*a* in the channel 34*d* of the base member 34 to pivot the base member 34 about the pivot 35 in a first, return direction as shown in FIGS. 6-9. The second cam 42*b* then preferably interacts with a second follower surface 34*b* in the channel 34*d* of the base member 34 to pivot the base member 34 about the pivot 35 in a second, propulsion direction opposite the first direction as shown in FIGS. 10-15. The forward-rearward cycle is repeated as long as the worm gear 40 is driven. Preferably, the first and second cams 42*a*, 42*b* of the first cam member 42 are oriented and configured so that motion of the base member 34 in the first, return direction begins immediately after motion in the second propulsion direction is completed and vice versa so that there is no noticeable lag. However, one or more of the base members 34 can be made to dwell, if desired, particularly in the first, return direction of the movement when the leg assembly will be elevated from the surface supporting the device 10, as will be described. Additionally, it is preferred that the first and second cams 42*a*, 42*b* are configured such that the base member 34 moves faster (and thus for less time) in the first, return (i.e., forward) direction when elevated than it does in the second, propulsion (i.e. rearward) direction, preferably approximately 25% of the cycle time to move in the first, return (i.e., forward) direction and approximately 75% of the time in the opposite second (i.e., rearward/propulsion) direction. Although this is preferred, it is within the present invention that the first and second cams 42*a*, 42*b* be configured differently to vary the timing and/or the direction of motion of the base member 34, provided the device 10 is still capable of functioning as described herein.

Preferably each leg member 32 is pivotably attached to the base member 34 by a generally horizontal pivot shaft 36 to rotate or more particularly pivot about its central axis 36*a*. Preferably, each leg member 32 is biased in an upward direction by a bias member, such as a linear tension spring 46 (FIG. 16) of a torsional spring (not depicted) centered about the pivot shaft 36 between the leg member 32 and the base member 34, or another type of spring or spring member or elastomeric member (none depicted) disposed between the leg member 32 and the base member 34 or between the leg member 32 and a portion of the frame 12. Referring to FIGS. 2, 4, 5 and 16, the second cam member 44 and its third cam 44*a* interact with a follower 32*a* operably associated with the leg member 32. The follower 32*a* may be a roller or wheel as depicted or merely a surface. The second cam member 44 and third cam 44*a* function to maintain the leg member 32 in a lowered position (against the bias of the spring 46) while the base member 34 moves in the second direction and allows the leg member 32 to pivot about the pivot shaft 36 to a raised position (with the bias of the spring 46) while the base member 34 moves in the first, return direction. By coordinating the vertical and horizontal pivoting motion of each leg member 32 in this way, the first, second and third cams 42*a*, 42*b* and 44*a*, function to move the leg member 32 in a cycle walking motion depicted in FIG. 17.

The horizontal, forward/rearward movements generated by the first and second cams 42*a*, 42*b* are illustrated in FIG. 17 where the center leg member 32 is depicted in solid half way through a forward horizontal movement in the first (return) direction between points I and II. The rearward horizontal movement in a second propulsion direction (opposite the first) occurs between points III and IV. Also illustrated in FIG. 17 are vertical movements, a downward movement between points II and III and an upward movement between points IV and I, caused by the third cam 44*a*. The pivot 35 and shaft 36 and their central axes 35*a*, 36*a* are at least generally transverse to one another to provide two degrees of freedom of rotation to each leg member 35 and are preferably at least essentially perpendicular to one another to maximize the two degrees of freedom of movement to each leg assembly to permit the two dimensional movement of the leg members 32 in a generally vertical, longitudinal extending plane that is illustrated in FIG. 17. In this way, each of the leg members 32 is actuated by the drive mechanism 13 to rotate about the first and second axes 35*a*, 36*a* in the like, predetermined repeatable cycle of movements depicted in FIG. 17.

Referring to FIGS. 18-23, the first, second and third cam 42*a*, 42*b* and 44*a* of the leg assemblies 30 are preferably configured such that the phase of the cyclic movement of each of the leg members on a lateral side are varied from one another such that only one of the three leg members 32 on each side of the two device 10 is lifted from the travel surface at any given time. That is, only one leg member 32 on each side is in the raised position and pivoting in the first, return (forward) direction at a time while the other two leg members 32 of each side are in the lowered position and pivoting in the second (rearward) direction to impart forward motion to the toy device 10. In particular, the three legs in the foreground on the lateral side 10*a* of device 10 are raised and moved in the first, return direction one at a time from the leftmost leg member to the rightmost leg member. It can be further seen that the remaining three legs in the background on the opposite lateral side (10*b*) of the device 10 are similarly being raised and moved in the rearward direction from the leftmost to the rightmost leg member 30 (as viewed in the figure) but are displaced by a partial cycle from the leg members in the foreground. In this way, a sufficient member of the leg members 32 are in contact with the surface S to at all times support the toy device 10 in an upright manner illustrated and to produce an anatomic-like gait of the device 10 on the surface S upon actuation.

It is noted that the just described motion of the leg members 32 occurs only when both motors 14 are driven in a rotary direction causing "forward" movement of the device 10. When both of the motors 14 are driven in an opposite rotary direction causing "rearward" movement, the cyclic motion of the leg members 32 is reversed as is the direction of the cycle of each leg member 32 illustrated in FIG. 17. Turning of the toy device 10 can be accomplished by driving one of the motors 14 in a forward-motion rotary direction and the other of the motors 14 in the rearward-motion rotary direction or by driving only one of the motors 14 or by driving both motors 14 but at different speeds.

It will be appreciated by those skilled in the art that changes could be made to the embodiment described above without departing from the broad inventive concept thereof. In one important aspect of the invention, as few as a pair of the leg assemblies on opposite sides of the toy device could be used to propel the toy device. Two leg assemblies also could be used to support or at least partially support the toy device. For example, the distal, surface contacting end of each leg could be provided with a member or surface that resists rearward motion while permitting forward motion. This would permit each leg to be moved from a forward position to a rearward position as described above and brought back to a forward position without being raised from the support surface in a shuffling or sliding movement. Alternatively or in addition, each leg could be pivoted slightly downwardly at the end of its rearward movement to momentarily tilt the toy device away from that side before the leg is slightly raised from the surface and returned to a forward position. Thus a chassis with one or more support wheels or equivalents such as castors or skids could be provided and the leg assemblies used only for propulsion or propulsion and partial support. Four leg assemblies could be used to mimic four-legged creatures (e.g., mammals, amphibians, and reptiles) while eight leg assemblies can be used to mimic arachnids.

The toy device 10 is conventionally powered by an on-board power source, such as a battery, or battery pack (not shown). Furthermore, it is preferred that the toy device 10 have conventional remote control electronics (not shown) for example mounted on a circuit board 22 (see FIG. 18) and including conventional radio receiver, microprocessor and appropriate motor control circuits (none depicted) to be remotely controlled by a user using a generally conventional remote control device (not shown) spaced from the toy device 10.

While remote control of the toy device is preferred, it will be appreciated that the toy device can be factory preprogrammed to perform a predetermined movement or series of movements or can be configured to be selectively programmed by a user to create such predetermined movement(s). Alternatively or in addition, the toy device can be equipped with sensors, e.g., switches, proximity detectors, etc., that will control the toy device to turn away from or reverse itself automatically from whatever direction it was moving in if or when an obstacle is contacted or otherwise sensed.

Furthermore, while two, independently operatively, reversible electric motors are preferred, the toy device could easily be propelled by a single motor in a conventional fashion where one of the drive trains on one side of the toy device is in continuously engages the motor with the leg assemblies on one side of the toy device and the other leg assemblies are connected to the motor through an additional throw-out gear and idler, which maintain the output of the drive reaching the other leg assemblies in the same rotational direction regardless of the rotational direction of the motor. This arrangement is sometimes referred to as J-drive.

It is understood, therefore, that this invention is not limited to the particular embodiment disclosed, but it is intended to cover modifications within the spirit and scope of the present invention.

We claim:

1. An articulated walking toy device configured for movement across a surface, the toy device comprising:

a frame;

a plurality of leg assemblies movably coupled with the frame, each leg assembly including a leg member configured to rotate with respect to the frame about separate first and second axes, the first and second axes being at least generally transverse to one another; and a drive mechanism operatively engaged with the plurality of leg assemblies so as to actuate each of the leg members of the plurality to rotate about the first and second axes in a like, predetermined, repeatable cycle of movement, with at least some of the leg members of the plurality being out of phase with other leg members of the plurality to produce an anatomic-like gait of the toy device on the surface upon actuation of the drive mechanism;

wherein each leg assembly further comprises:

a base member movably disposed on the frame, the base member having a channel therein with first and second follower surfaces, the leg member being engaged with the base member so as to pivot with respect to the base member about the second axis; and first and second cams rotatably coupled with the drive mechanism and positioned in the channel of the base member in contact with the first and second follower surfaces, respectively, to cyclically rotate the base member and the leg member with respect to the first axis.

2. The articulated walking toy device of claim 1, wherein each leg assembly further comprises:

a third cam rotatably fixed with the first and second cams;

a follower of the leg member in contact with the third cam; and a bias member coupled with the leg member so as to bias the leg member in a first pivoted position with respect to the base member with the follower abutting the second cam member, the second cam member being shaped to alternately push the follower and leg member to a second pivoted position with respect to the base member.

3. The articulated walking toy device of claim 1, wherein cyclic movement of each of the leg members generally about the first axis by the first and second cams and pivoting of each of the leg members about the second axis by the third cam is coordinated so that the leg member is moved to and from the first pivoted position while the leg member rotates in a first, generally horizontal direction and remains in the second pivoted position while the leg member rotates in a second, generally horizontal direction opposite the first generally horizontal direction.

4. The articulated walking toy device of claim 3, wherein interaction of the first cam with the first follower surface causes rotation of the base member and leg member in the first generally horizontal direction and interaction of the second cam with the second follower surface causes rotation of the base member and leg member in the second generally horizontal direction.

5. The articulated walking toy device of claim 4, wherein the first and second cams are configured so that, for each rotational cycle of the leg assembly, each leg member is rotated faster in the first direction of the cycle of movement than each leg member is rotated in the second direction during a remainder of the cycle of movement.

6. The articulated walking toy device of claim 1, wherein the drive mechanism comprises:

at least a first motor supported from the frame; and drive shafting driven by the first motor and drivingly coupled to at least the leg assemblies disposed on a first lateral side of the device.

7. The articulated walking toy device of claim 6, wherein the drive mechanism further comprises:

a second motor supported from the frame and drivingly coupled to the leg assemblies disposed on a second lateral side of the device.

8. The articulated walking toy device of claim 6, wherein each leg assembly on at least the first lateral side of the frame includes:

a worm gear rotatably fixed with at least the first and second cams; and wherein the drive mechanism further includes:

worms drivingly coupled together with the drive shafting and meshed with the worm gears on the first lateral side of the frame so that rotation of the drive shafting and worms by the first motor causes rotation of each of the worm gears and the first and second cams on the first lateral side of the frame to drive each of the leg assemblies on the first lateral side of the frame.

9. The articulated walking toy device of claim 8 wherein each leg assembly includes a third cam rotatably fixed with the first and second cams and worm gear of the assembly to be rotated together.

10. The articulated walking toy device of claim 9 wherein each leg member includes a follower contacted by the third cam.

11. The articulated walking toy device of claim 1, wherein the frame includes first and second plates spaced apart from one another, the plurality of leg assemblies being disposed between the first and second plates.

12. The articulated walking toy device of claim 1, wherein the first and second axes are essentially mutually perpendicular.

13. An articulated toy device configured for walking movement across a surface, the device comprising:

a frame;

a plurality of leg assemblies engaged with the frame, each leg assembly including a leg member coupled with the frame for movement with respect to the frame in at least two directions transverse to one another, each leg assembly further including at least two cams operably coupled with the leg member so as to move the leg member in different directions with respect to the frame, each of the leg assemblies further including a base member movably coupled with the frame and movably supporting the leg member; and a drive mechanism drivingly engaged with each of the plurality of leg assemblies through at least the first and second cams of each leg assembly so as to cause each of the leg members of the assemblies to move in the at least two different directions in a like, predetermined, repeatable cycle of movement of each leg member, with movement of at least some of the plurality of the leg members being unsynchronized with movement of others of the plurality of the leg members, such that the plurality of leg members produce an anatomic-like gait of the device across the surface, at least a first of the two cams is operably coupled with the leg member through the base member so as to move the base member and the leg member in a direction with respect to the frame opposite from a direction of movement of the leg member by a second of the two cams.

14. The device of claim 13, wherein each of the first cam and the second cam is configured to move the base member with respect to the frame in at least a separate one of the two opposing directions at different speeds.

15. The device of claim 13, wherein the first and second cams are coaxial and wherein the base member of each of the plurality of leg assemblies has a channel therethrough with first and second follower surfaces located for contact with the coaxial first and second cams, respectively.

16. The device of claim 13, wherein the base of each of the plurality of leg assemblies is pivotally coupled to the frame to restrict the movement of the base member with respect to the frame to essentially only the two opposing directions.

17. The device of claim 13, wherein each of the leg assemblies is installed to be out of phase with respect to each other immediately adjoining leg member.

18. The device of claim 13, having at least four of the leg assemblies with an identical number of the leg assemblies being located on either of two opposing lateral sides of the device and wherein the leg assemblies are configured such that, at all times at least one of the leg members on either of the two opposing lateral sides of the device is in contact with the surface to support the device on the surface.

19. The device of claim 18, wherein the plurality of leg members are out of phase such that, at all times, at least a third leg member is in contact with the surface so as to support the device upright on the surface with at least three of the plurality of leg members.

20. An articulated toy device configured for walking movement across a surface, the device comprising:

a frame;

a plurality of leg assemblies engaged with the frame, each leg assembly including a leg member having a proximal end coupled with the frame for movement with respect to the frame in at least two directions transverse to one another, each leg assembly further including at least two cams operably coupled with the leg member so as to move the leg member in different directions with respect to the frame; and a drive mechanism drivingly engaged with each of the plurality of leg assemblies through at least the first and second cams of each leg assembly so as to cause each of the leg members of the assemblies to move in the at least two different directions in a like, predetermined, repeatable cycle of movement of each leg member, with movement of at least some of the plurality of the leg members being unsynchronized with movement of others of the plurality of the leg members, such that the plurality of leg members produce an anatomic-like gait of the device across the surface, wherein one of the two cams moves the proximal end of the leg member in one direction and another of the two cams moves the proximal end of the leg member in another direction substantially perpendicular to the one direction of movement of the proximal end of the leg member by the one cam;

wherein each leg assembly includes a base member movably coupling the leg member with the frame and wherein the one cam contacts and moves the base member with respect to the frame and the other cam contacts and moves the leg member with respect to the base member.

21. The device of claim 20, wherein the two cams are coaxial.

22. An articulated toy device configured for walking movement across a surface, the device comprising:

a frame;

a plurality of leg assemblies engaged with the frame, each leg assembly including a leg member having a proximal end coupled with the frame for movement with respect to the frame in at least two directions transverse to one another, each leg assembly further including at least two cams operably coupled with the leg member so as to move the leg member in different directions with respect to the frame; and a drive mechanism drivingly engaged with each of the plurality of leg assemblies through at least the first and second cams of each leg assembly so as to cause each of the leg members of the assemblies to move in the at least two different directions in a like, predetermined, repeatable cycle of movement of each leg member, with movement of at least some of the plurality of the leg members being unsynchronized with movement of others of the plurality of the leg members, such that the plurality of leg members produce an anatomic-like gait of the device across the surface, wherein one of the two cams moves the proximal end of the leg member in one direction and another of the two cams moves the proximal end of the leg member in another direction substantially perpendicular to the one direction of movement of the proximal end of the leg member by the one cam;

wherein each leg assembly further includes a third cam.

23. The device of claim 22 wherein the two cams and the third cam are fixedly coupled together sufficiently to rotate together coaxially.

24. An articulated toy device configured for walking movement across a surface, the device comprising:

a frame;

a plurality of leg assemblies engaged with the frame, each leg assembly including a leg member coupled with the frame for movement with respect to the frame in at least two directions transverse to one another, each leg assembly further including at least two cams operably coupled with the leg member so as to move the leg member in different directions about a first axis with respect to the frame and a third cam operably associated with each leg assembly to move the leg member about a second axis transverse to the first axis about which the leg member is moved by the two cams; and a drive mechanism drivingly engaged with each of the plurality of leg assemblies through at least the first and second cams of each leg assembly so as to cause each of the leg members of the assemblies to move in the at least two different directions in a like, predetermined, repeatable cycle of movement of each leg member, with movement of at least some of the plurality of the leg members being unsynchronized with movement of others of the plurality of the leg members, such that the plurality of leg members produce an anatomic-like gait of the device across the surface.

25. The device of claim 24, wherein the first and second axes are essentially mutually perpendicular.

26. The device of claim 24, wherein the first, second, and the third cams are all coaxially coupled for rotation together.

27. The device of claim 26, further comprising a gear fixedly coupled with the first, second, and third cams so as to rotate the first, second, and third cams together and wherein the drive mechanism includes at least one motor and a drive train drivingly coupled between the motor and the gear of each of at least some of the plurality of leg assemblies to rotate the three cams and actuate the coupled leg members of the coupled leg assemblies.

* * * * *